US009586422B2

(12) United States Patent
Tsuchiya et al.

(10) Patent No.: US 9,586,422 B2
(45) Date of Patent: Mar. 7, 2017

(54) PRINTER ASSEMBLED FROM MAINFRAME AND MULTIPLE FUNCTION UNITS

(75) Inventors: Masahiro Tsuchiya, Tokyo (JP); Tetsuhiro Ishikawa, Tokyo (JP); Sumio Watanabe, Tokyo (JP); Yukihiro Mori, Tokyo (JP); Masaru Kihara, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 13/533,048

(22) Filed: Jun. 26, 2012

(65) Prior Publication Data

US 2013/0001351 A1 Jan. 3, 2013

(30) Foreign Application Priority Data

Jun. 29, 2011 (JP) ..... 2011-144948
Jun. 29, 2011 (JP) ..... 2011-144949
Jun. 29, 2011 (JP) ..... 2011-144950

(51) Int. Cl.
*B65H 3/68* (2006.01)
*G03G 21/00* (2006.01)
*B41J 15/04* (2006.01)
*B41J 15/02* (2006.01)

(52) U.S. Cl.
CPC ..... *B41J 15/042* (2013.01); *B41J 15/02* (2013.01)

(58) Field of Classification Search
CPC .... B65H 23/16; B65H 16/04; B65H 2404/54; B41J 15/165; B41J 23/26; B41J 17/24
USPC ..... 400/613, 618, 691; 101/DIG. 42; 242/597
See application file for complete search history.

(56) References Cited

U.S. PATENT DOCUMENTS 4,170,407 A * 10/1979 Stella ..... 352/72
5,033,881 A * 7/1991 Koike ..... 400/613
5,706,729 A * 1/1998 Tai et al. ..... 101/288
5,947,618 A * 9/1999 Keller et al. ..... 400/613
6,203,223 B1 3/2001 Nakayama et al.
6,256,862 B1 * 7/2001 Olden et al. ..... 29/564.6
6,302,604 B1 10/2001 Bryant et al.
6,367,731 B1 4/2002 Takizawa et al.
6,607,322 B2 * 8/2003 Aruga et al. ..... 400/613
(Continued)

FOREIGN PATENT DOCUMENTS

JP 04173278 A * 6/1992 ..... B41J 15/16
JP 05046044 A * 2/1993 ..... G03G 15/20
(Continued)

*Primary Examiner* — Jill Culler
*Assistant Examiner* — Ruben Parco, Jr.
(74) *Attorney, Agent, or Firm* — IPUSA, PLLC

(57) ABSTRACT

A printer includes a mainframe including a front face part that has an opening through which a recording medium passes; a guide unit connected to the mainframe on a first side of the front face part; a printer mechanism unit configured to perform printing on the recording medium, and connected to the mainframe on a second side of the front face part opposite to the first side thereof; an arm unit having a first end connected to the mainframe; and a shaft unit configured to hold a roll of the recording medium, and connected to a second end of the arm unit, wherein the guide unit is configured to guide the recording medium so as to feed the recording medium to the printer mechanism unit through the opening of the front face part of the mainframe.

13 Claims, 47 Drawing Sheets

(56) References Cited

U.S. PATENT DOCUMENTS

| | | | | |
|---|---|---|---|---|
| 6,814,515 | B2 | 11/2004 | Tsuchiya et al. | |
| 7,632,032 | B2 * | 12/2009 | Silverbrook | B41J 2/17513 400/692 |
| 7,857,534 | B2 | 12/2010 | Watanabe et al. | |
| 2002/0081132 | A1 * | 6/2002 | Miyamoto et al. | 399/384 |
| 2005/0206715 | A1 | 9/2005 | Sasaki et al. | |
| 2005/0286954 | A1 * | 12/2005 | Suzuki et al. | 400/613 |
| 2006/0039738 | A1 * | 2/2006 | Murata et al. | 400/615.2 |
| 2006/0104698 | A1 * | 5/2006 | Koike et al. | 400/605 |
| 2007/0009305 | A1 | 1/2007 | Sakaino et al. | |
| 2007/0036604 | A1 * | 2/2007 | Maekawa et al. | 400/615.2 |
| 2011/0063391 | A1 * | 3/2011 | Miyamoto et al. | 347/104 |

FOREIGN PATENT DOCUMENTS

| | | | | |
|---|---|---|---|---|
| JP | H09-263348 | | 10/1997 | |
| JP | 2843709 | | 1/1999 | |
| JP | H11-079480 | | 3/1999 | |
| JP | 2000-016641 | | 1/2000 | |
| JP | 2000-016652 | | 1/2000 | |
| JP | 2000-233856 | | 8/2000 | |
| JP | 2001-080803 | | 3/2001 | |
| JP | 2001-226029 | | 8/2001 | |
| JP | 2002-241006 | | 8/2002 | |
| JP | 2003-019845 | | 1/2003 | |
| JP | 2003-063096 | | 3/2003 | |
| JP | 2004-122430 | | 4/2004 | |
| JP | 2004-322464 | | 11/2004 | |
| JP | 2005193544 | A * | 7/2005 | B41J 29/38 |
| JP | 2006-054032 | | 3/2006 | |
| JP | 2007-130842 | | 5/2007 | |
| JP | 2007-326235 | | 12/2007 | |
| JP | 2010074014 | A * | 4/2010 | H05K 7/14 |
| JP | 2011088366 | A * | 5/2011 | B41J 15/16 |
| JP | 2011-104321 | | 6/2011 | |

* cited by examiner

PRINTER ASSEMBLED FROM MAINFRAME AND MULTIPLE FUNCTION UNITS

CROSS-REFERENCE TO RELATED APPLICATIONS

This application is based upon and claims the benefit of priority of Japanese Patent Application No. 2011-144948, filed on Jun. 29, 2011, Japanese Patent Application No. 2011-144949, filed on Jun. 29, 2011, and Japanese Patent Application No. 2011-144950, filed on Jun. 29, 2011, the entire contents of which are incorporated herein by reference.

FIELD

A certain aspect of the embodiments discussed herein is related to a printer.

BACKGROUND

Printers that output paper slips such as receipts are widely used for shops' registers and automated teller machines (ATMs) or cash dispensers (CDs) in banks.

Such printers that output receipts contain rolled (a roll of) thermal paper serving as recording paper. Printing is performed on the recording paper with a thermal head while conveying the recording paper. After conveying the recording paper a predetermined length, the recording paper is cut with a cutter to the predetermined length.

For related art, reference may be made to Japanese Laid-Open Patent Application No. 2003-19845, Japanese Laid-Open Patent Application No. 2007-130842, and Japanese Laid-Open Patent Application No. 2006-56032.

SUMMARY

According to an aspect of the invention, a printer includes a mainframe including a front face part that has an opening through which a recording medium passes; a guide unit connected to the mainframe on a first side of the front face part; a printer mechanism unit configured to perform printing on the recording medium, and connected to the mainframe on a second side of the front face part opposite to the first side thereof; an arm unit having a first end connected to the mainframe; and a shaft unit configured to hold a roll of the recording medium, and connected to a second end of the arm unit, wherein the guide unit is configured to guide the recording medium so as to feed the recording medium to the printer mechanism unit through the opening of the front face part of the mainframe.

According to an aspect of the invention, a printer includes a paper feed shaft unit configured to hold a roll of recording paper on which printing is to be performed, wherein the paper feed shaft unit includes a helical projection part at a surface of the paper feed shaft unit; and an arm unit connected to an end of the paper feed shaft unit in such a manner as to allow rotation of the paper feed shaft unit, wherein the helical projection part is helically formed so as to be directed toward the end of the paper feed shaft unit.

According to an aspect of the invention, a printer includes a paper feed shaft unit including a holding part at a first end thereof, wherein the holding part is configured to hold a roll of recording paper on which printing is to be performed; and an arm unit connected to a second end of the paper feed shaft unit in such a manner as to allow rotation of the paper feed shaft unit, wherein the holding part is positioned across the roll of the recording paper from the arm unit when the roll of the recording paper is attached to the paper feed shaft unit.

According to an aspect of the invention, a printer includes a paper feed shaft unit configured to hold a roll of recording paper on which printing is to be performed; and an arm unit connected to a first end of the paper feed shaft unit in such a manner as to allow rotation of the paper feed shaft unit, wherein the paper feed shaft unit is connected to the arm unit so that a second end of the paper feed shaft unit is positioned higher than the first end thereof in a vertical direction.

According to an aspect of the invention, a printer includes a printer mechanism unit configured to perform printing on recording paper loaded in a rolled state; a recording paper guide unit configured to guide the recording paper to the printer mechanism unit, wherein the recording paper guide unit includes a first guide part and a second guide part, the first guide part includes a first spring configured to apply a force to the first guide part in a direction toward the second guide part, the second guide part includes a second spring configured to apply a force to the second guide part in a direction toward the first guide part, and the recording paper guide unit is configured to guide the recording paper to the printer mechanism unit through a passage between the first guide part and the second guide part.

According to an aspect of the invention, a printer includes a printer mechanism unit configured to perform printing on recording paper loaded in a rolled state; a recording paper guide unit configured to guide the recording paper to the printer mechanism unit, wherein the recording paper guide unit includes a first leaf spring part and a second leaf spring part, the first leaf spring part is configured to apply a force in a direction toward the second leaf spring part, the second leaf spring part is configured to apply a force in a direction toward the first leaf spring part, and the recording paper guide unit is configured to guide the recording paper to the printer mechanism unit through a passage between the first leaf spring part and the second leaf spring part.

The object and advantages of the embodiments will be realized and attained by means of the elements and combinations particularly pointed out in the claims.

It is to be understood that both the foregoing general description and the following detailed description are exemplary and explanatory and not restrictive of the invention.

BRIEF DESCRIPTION OF THE DRAWINGS

Other objects, features and advantages of the present invention will become more apparent from the following detailed description when read in conjunction with the accompanying drawings, in which.

DESCRIPTION OF EMBODIMENTS

Figure 1:
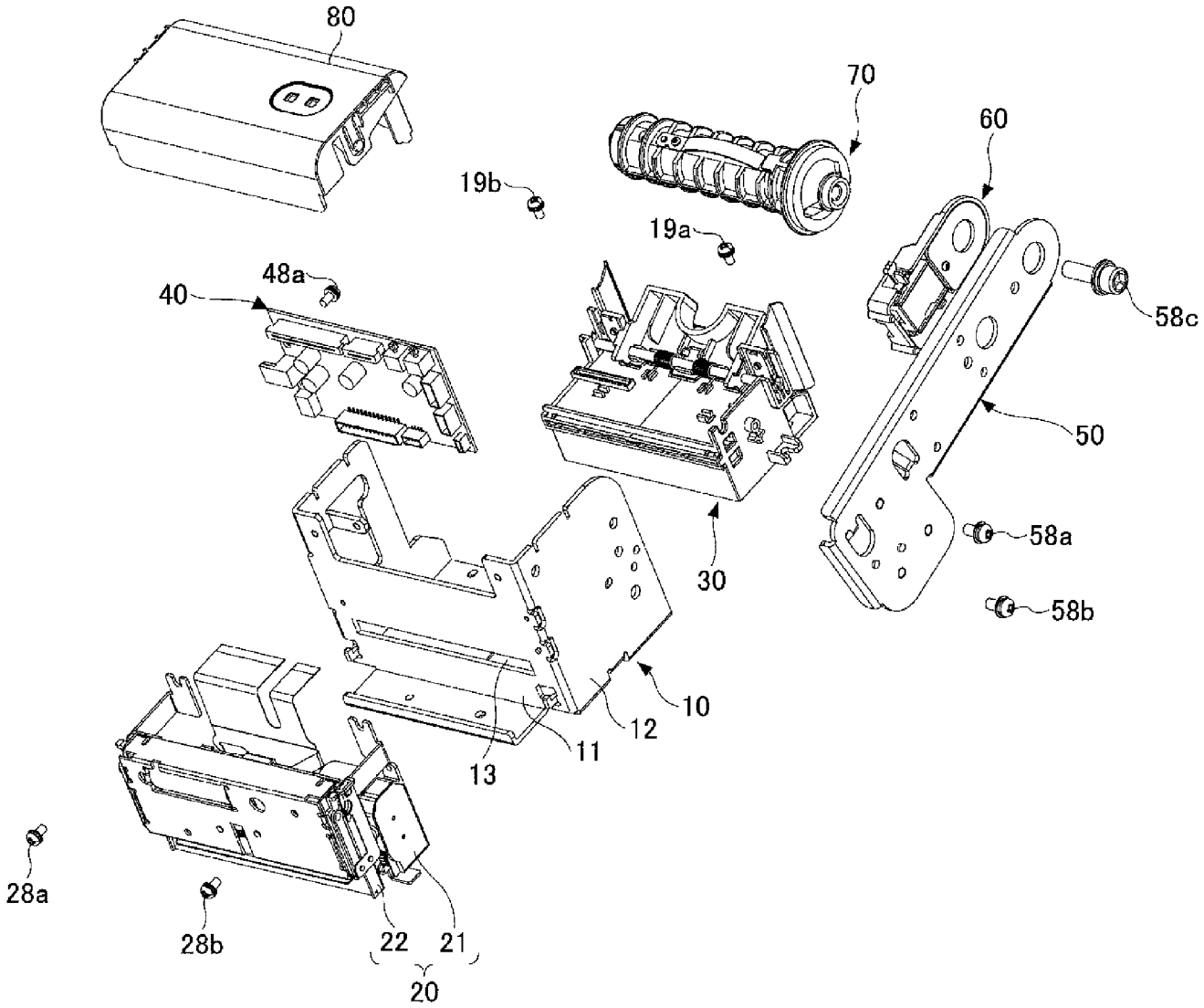
FIG. 1 is an exploded perspective view of a printer according to a first embodiment, illustrating units of the printer.

Such printers that output receipts as described above, which include multiple components, employ different components depending on their use. Therefore, different printers are suitably manufactured in accordance with specific uses, which, however, is likely to cause confusion at the time of manufacturing and also complicates the manufacturing process, thus imposing a manufacturing load. Further, if a printer fails and it is possible to replace only the failed part of the printer, it is easy to perform maintenance work and it is possible to reduce repair time.

Further, such printers use rolled thermal paper as recording paper, and include a paper feed shaft and an arm for holding the rolled recording paper. As a system for holding the paper feed shaft to which the recording paper is attached, some printers employ a single arm, which printers may be referred to as a single-holding type, and other printers employ two arms, which printers may be referred to as a double-holding type. Of these, the single-holding type printers may be compact and reduced in weight.

According to the single-holding type printers, however, one end of the paper feed shaft is connected to the arm, but the other end of the paper feed shaft is connected to nothing and is left open (free). Therefore, there is a problem in that the rolled recording paper rotates to gradually move toward the other end of the paper feed shaft so that the recording paper eventually falls off from the other end of the paper feed shaft.

In order to prevent the attached recording paper from falling off of the paper feed shaft, a member for preventing the falling-off of the recording paper may be attached to the other end of the paper feed shaft. However, providing such a member causes other problems such as an increase in cost due to an increase in the number of components and an increase in time for attaching the recording paper.

Further, such printers are prevented from perform printing until the next roll of recording paper is loaded once the loaded recording paper finishes. This creates time in which printing is not performable, thus causing inconvenience at the time of printing.

Further, the recording paper is relatively large in volume, so that the recording paper is provided in different locations depending on the use of printers.

According to an aspect of the invention, a printer is provided that does not impose a manufacturing load and is easily manufactured in accordance with the intended use.

According to an aspect of the invention, a printer is provided that has a structure that allows maintenance work to be performed easily even when there is a failure in the printer.

According to an aspect of the invention, a single-holding type printer that holds recording paper with a single arm is provided that prevents the rolled recording paper from falling off of the paper feed shaft without an increase in cost.

According to an aspect of the invention, a printer is provided that is capable of performing printing without generation of time in which printing is not performable even when recording paper finishes.

According to an aspect of the invention, a printer is provided that allows the location where recording paper is provided to be easily changed.

Preferred embodiments of the present invention will be explained with reference to the accompanying drawings. In the following, the same elements or members are referred to by the same reference numeral, and a redundant description thereof is omitted.

[a] First Embodiment

A description is given of a structure of a printer according to a first embodiment. A printer according to this embodiment is composed of multiple units, and may easily be adapted to suit a desired purpose by replacing individual units. That is, conventionally, printers are composed of multiple components, but include different components depending on their use. Therefore, manufacturing different types of printers complicates the manufacturing process, thus being likely to cause confusion at the time of manufacturing.

A printer according to this embodiment is unitized on a function basis, and a desired printer may be manufactured by combining and assembling individual units. That is, different types of printers may easily be manufactured in accordance with use by combining (attaching) units as desired in accordance with use. Further, a printer according to this embodiment is thus manufactured by combining multiple units. Therefore, when a failure occurs, maintenance work such as repairing may be performed in a short time by replacing a failed unit as a whole. This makes it possible to reduce time during which the printer is unusable because of a failure or the like, and to prevent a decrease in the operation rate of the printer as much as possible.

A description is given, with reference to FIG. 1, of a printer according to this embodiment. The printer of this embodiment includes a mainframe 10, a printer mechanism unit 20, a recording paper guide unit 30 (a guide unit), a control board unit 40, an arm unit 50, a near-end detecting unit 60, a paper feed shaft unit 70 (a shaft unit), and a cover 80.

Figure 2:
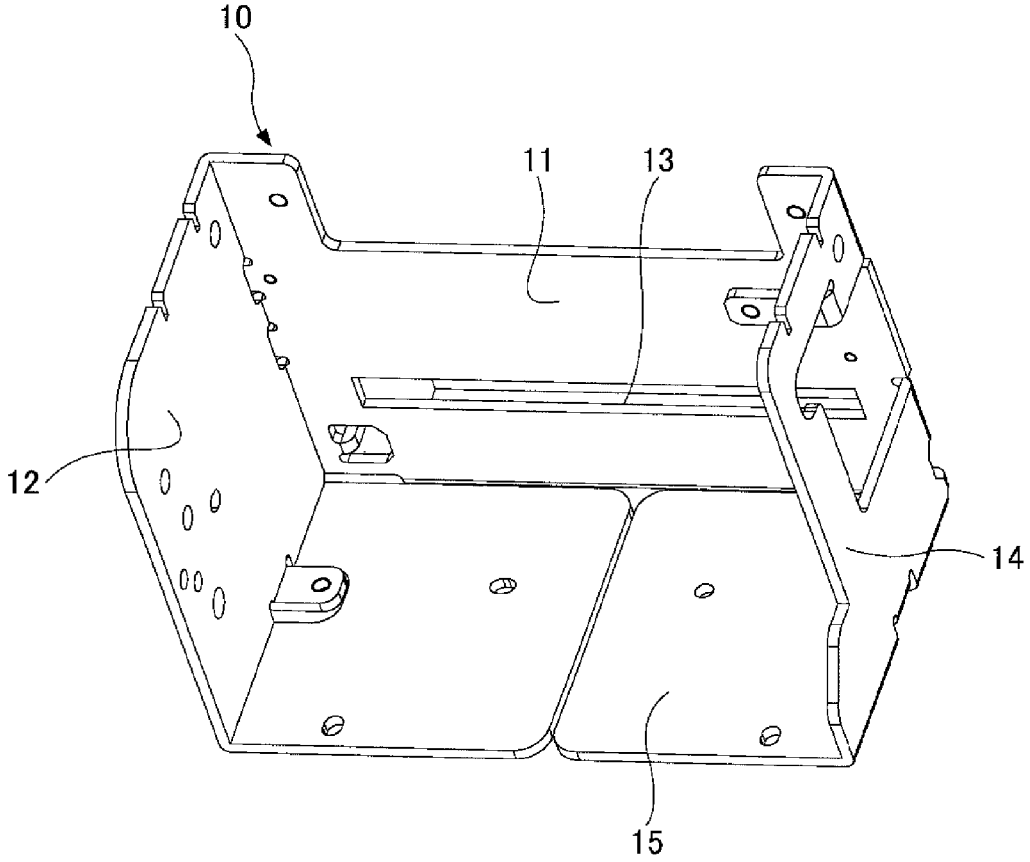
FIG. 2 is a perspective view of a mainframe according to the first embodiment.

The mainframe 10 is formed of a material having strength, such as metal. Referring also to FIG. 2, the mainframe 10 includes a front face part 11 from (through) which a recording medium such as recording paper is discharged, and side face parts 12 and 14 substantially perpendicular to the front face part 11. The front face part 11 and the side face parts 12 and 14 may be formed by bending a plate material substantially 90 degrees at each end. The front face part 11 includes an opening 13 that allows passage of recording paper to be discharged. When the recording paper is discharged, the recording paper passes through the opening 13 in a direction from a first surface (an interior surface facing a space surrounded by the front face part 11 and the side face parts 12 and 14) to a second surface (an exterior surface) of the front face part 11, so that the recording paper is fed to the printer mechanism unit 20.

The printer mechanism unit 20 includes a printer unit 21 and a cutter unit 22, which may be separably connected. The cutter unit 22 and the printer unit 21 may be separated to be easily removed. According to this embodiment, the printer uses rolled (a roll of) thermal paper as a recording medium, and the printer unit 21 includes a thermal head 21*a* (FIG. 22) for performing printing on the recording (thermal) paper and a motor 21*b* (FIG. 22) and a platen roller 21*c* (FIG. 22) for conveying the recording paper. The cutter unit 22 is configured to cut the recording paper subjected to printing in the printer unit 21 to a predetermined length. The cutter unit 22 includes a fixed blade (not graphically illustrated) and a movable blade (not graphically illustrated). The recording paper is cut by the movement of the movable blade.

The recording paper guide unit 30 is configured to hold the rolled recording paper and to guide the recording paper to the printer unit 21 of the printer mechanism unit 20 through the opening 13 of the mainframe 10.

The control board 40 has electronic components mounted on a printed board or the like. The control board 40 controls, for example, printing on the recording paper in the printer mechanism unit 20, the conveyance of the recording paper, and the cutting of the recording paper.

The arm unit 50 is configured to hold the rolled recording paper attached to the paper feed shaft unit 70. The arm unit 50 has a shape elongated in one direction. The elongated arm unit 50 has one end connected to the side face part 12 of the mainframe 10 and has the other end connected to the paper feed shaft unit 70.

The near-end detecting unit 60 is configured to detect a remaining amount of the rolled recording paper. The near-end detecting unit 60 is connected between the arm unit 50 and the paper feed shaft unit 70, or is connected to the arm unit 50 on the side on which the arm unit 50 is connected to the paper feed shaft unit 70.

The paper feed shaft unit 70 is configured to hold the recording paper. The paper feed shaft unit 70 is inserted into the center opening of the recording paper roll to hold the recording paper. The paper feed shaft unit 70 is connected to the arm unit 50 to be substantially perpendicular to a surface of the arm unit 50.

The cover 80 covers (an upper part of) the mainframe 10 from above the mainframe 10.

Next, a description is given, with reference to FIG. 2, of the mainframe 10 of the printer according to this embodiment. According to this embodiment, the mainframe 10 includes the front face part 11 in which the opening 13 is provided, the side face part 12, the side face part 14, and a bottom face part 15. The side face parts 12 and 14 are in contact with the front face part 11. The side face parts 12 and 14 are provided at first and second opposite ends of the front face part 11 (to face each other across a space over the bottom face part 15). The side face parts 12 and 14 are bent substantially 90 degrees relative to the front face part 11. Accordingly, the side face parts 12 and 14 are substantially parallel to each other. The bottom face part 15 is in contact with the front face part 11 and the side face parts 12 and 14. According to this embodiment, the bottom face part 15 and the front face part 11 are substantially perpendicular to each other, and the bottom face part 15 is substantially perpendicular to each of the side face parts 12 and 14. The side face parts 12 and 14 and the bottom face part 15 are thus provided on the first surface side of the front face part 11.

According to this mainframe 10, the front face part 11, the side face parts 12 and 14, and the bottom face part 15 define four of the six sides of a parallelepiped shape. Accordingly, the individual units may be connected to the mainframe 10 using the remaining two sides. Therefore, the front face part 11, the side face parts 12 and 14, and the bottom face part 15 are provided with screw holes for connecting other units.

Next, a description is given of a method of manufacturing a printer according to this embodiment. The printer of this embodiment may be manufactured by connecting individual units to the mainframe 10.

Figure 3:
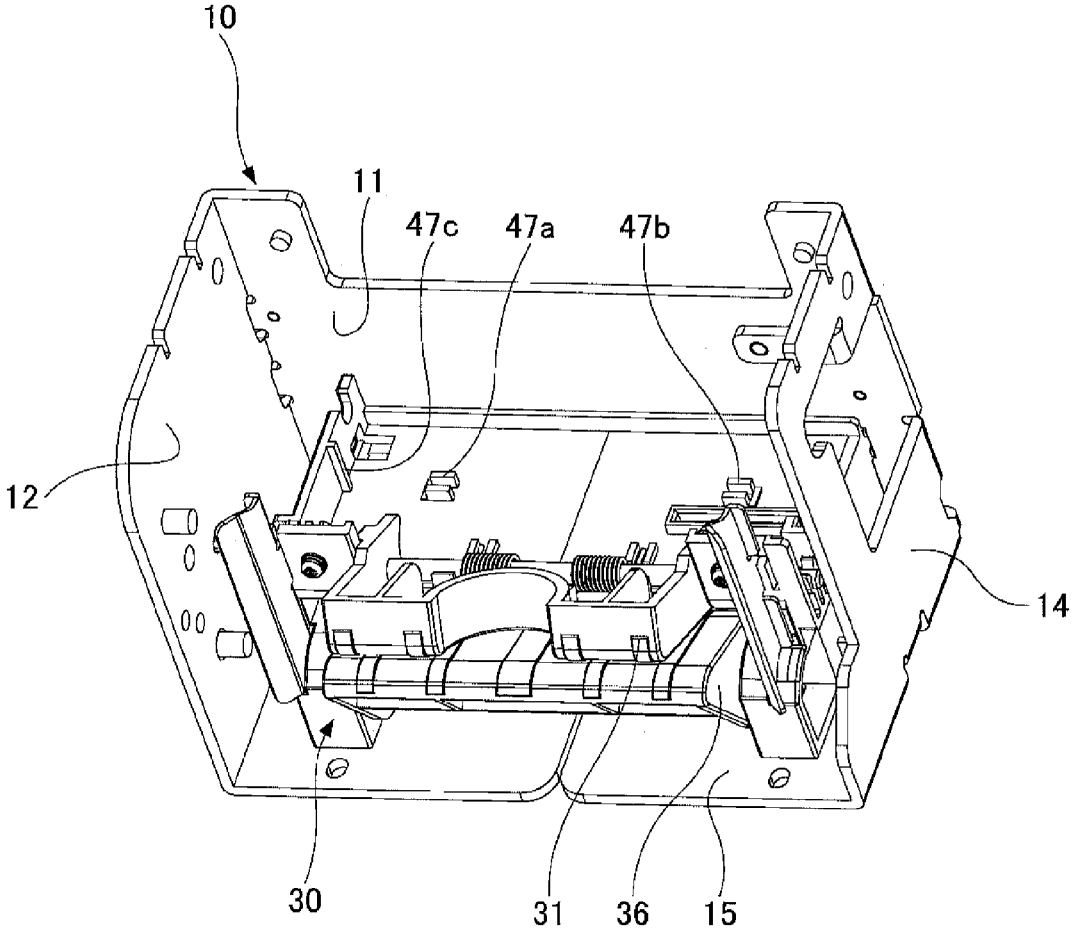
FIG. 3 is a perspective view of the mainframe and a recording paper guide unit connected to the mainframe according to the first embodiment.

First, as illustrated in FIG. 3, the recording paper guide unit 30 is connected to the bottom face part 15 of the mainframe 10. The recording paper guide unit 30 is connected to the bottom face part 15 by being screwed to the bottom face part 15. The recording paper guide unit 30 is so connected to the bottom face part 15 as to allow the recording paper to be inserted between an upper guide part 31 and a lower guide part 36 of the recording paper guide unit 30 to travel through a passage P (for example, FIG. 40 and FIG. 41) and further enter the opening 13 from the first surface side of the mainframe 10.

Figure 4:
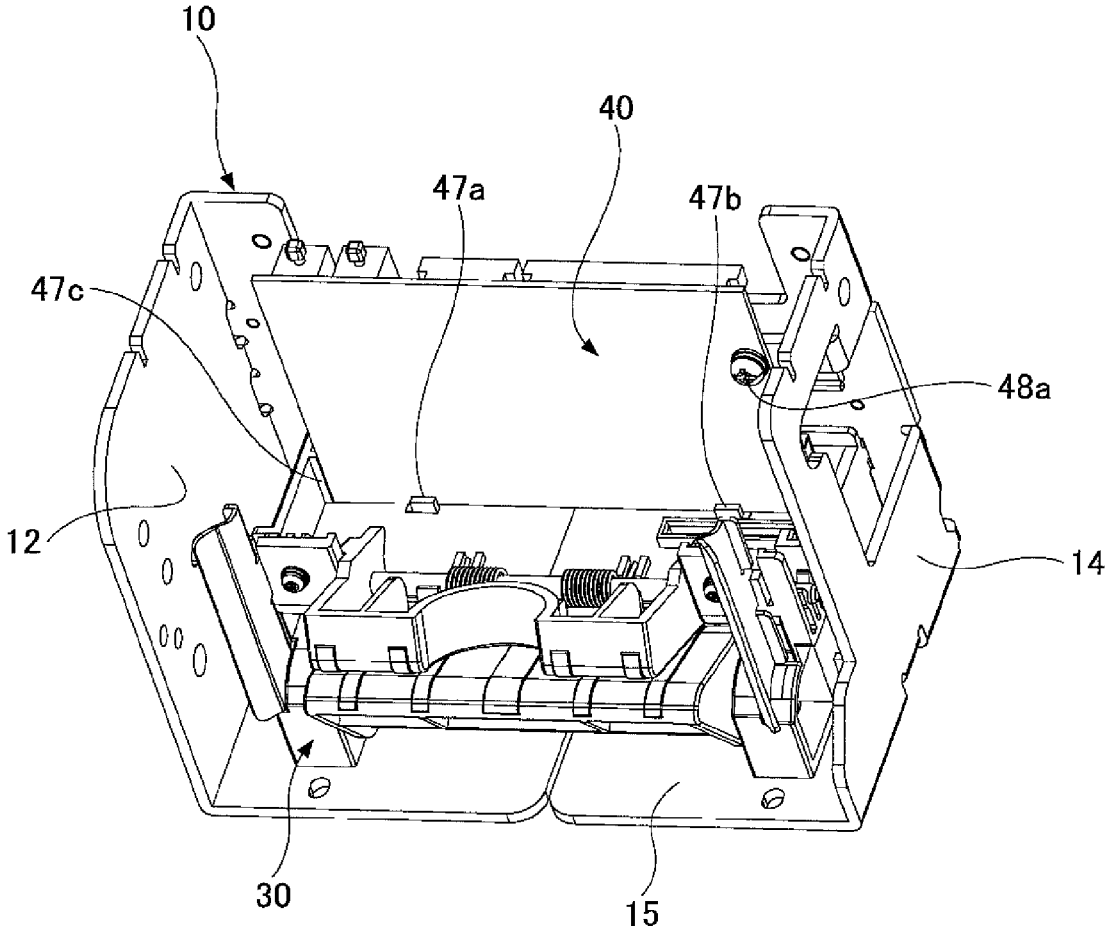
FIG. 4 is a perspective view of the mainframe and the recording paper guide unit and a control board unit connected to the mainframe according to the first embodiment.
Figure 5:
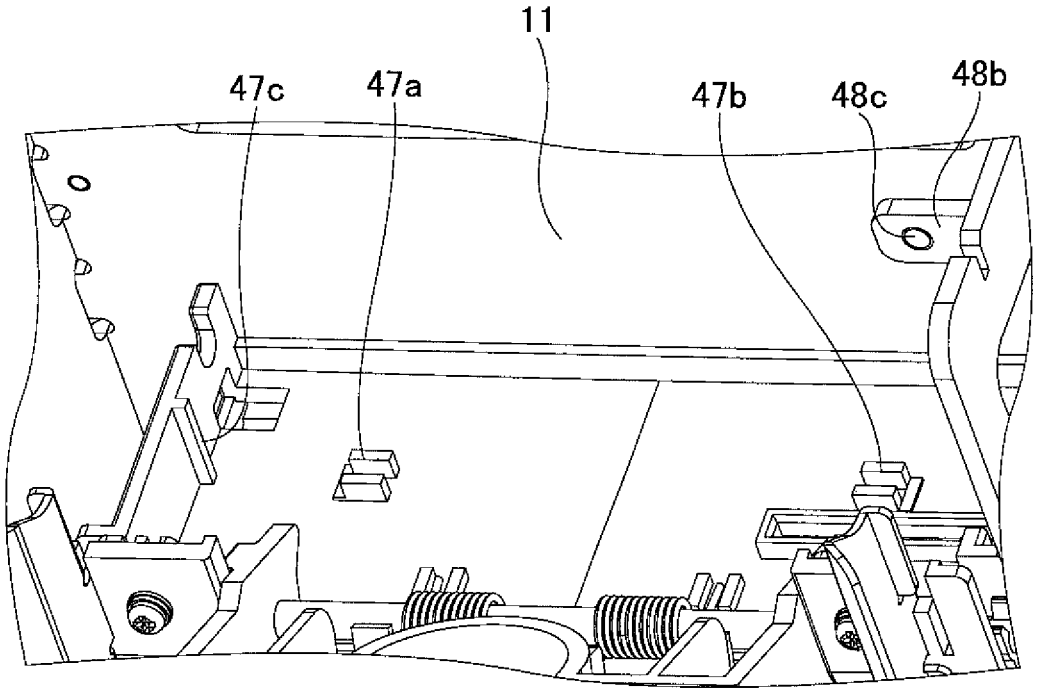
FIG. 5 is an enlarged view of part of the recording paper guide unit to which part the control board unit is connected according to the first embodiment.

Next, as illustrated in FIG. 4, the control board unit 40 is connected to the recording paper guide unit 30. For example, as illustrated in FIG. 5, the recording paper guide unit 30 includes control board fixing parts 47*a* and 47*b* of a concave shape and a control board holding part 47*c* of a projecting shape for installing the control board unit 40, which are provided in an upper part of the recording paper guide unit 30. Accordingly, in attaching the control board unit 40, the control board unit 40 is fit into the concave control board fixing parts 47*a* and 47*b* with the control board holding part 47*c* preventing the control board unit 40 from tilting, and the control board unit 40 is fixed with a screw 48*a* to a connecting part 48*b* provided on the side face part 14 of the mainframe 10, so that the control board unit 40 is connected to the recording paper guide unit 30. The connecting part 48*b* forms a substantially right angle with the side face part 14, and has a screw hole 48*c* corresponding in shape to the screw 48*a*.

Figure 6:
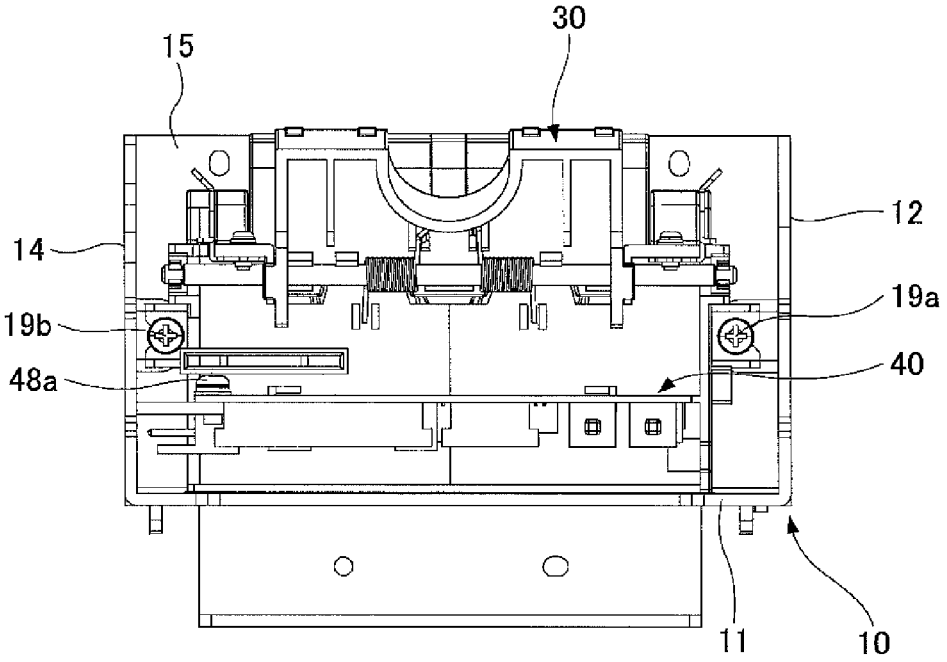
FIG. 6 is a plan view of the mainframe and the recording paper guide unit and the control board unit connected to the mainframe according to the first embodiment.
Figure 7:
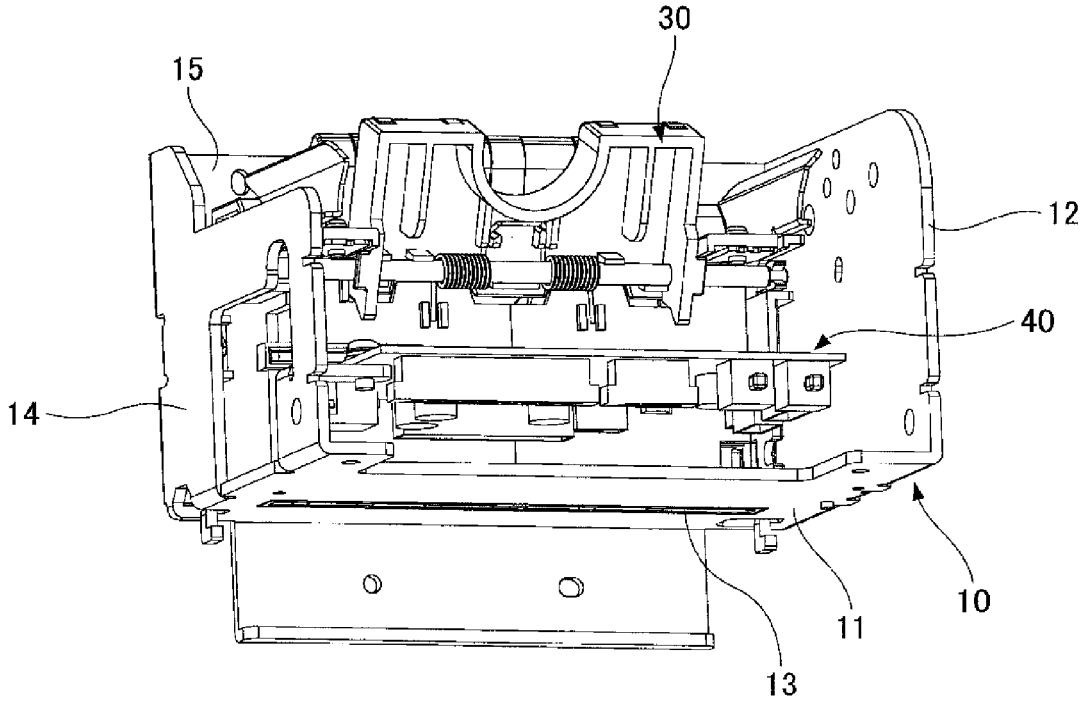
FIG. 7 is a tope-side perspective view of the mainframe and the recording paper guide unit and the control board unit connected to the mainframe according to the first embodiment.

FIG. 6 and FIG. 7 are a plan view and a top-side perspective view, respectively, of the above-described structure, where the recording paper guide unit 30 and the control board unit 40 are connected to the mainframe 10. As illustrated in FIG. 6, the recording paper guide unit 30 is connected to the bottom face part 15 of the mainframe 10 by being screwed to the bottom face part 15 with screws 19*a* and 19*b*.

Figure 8:
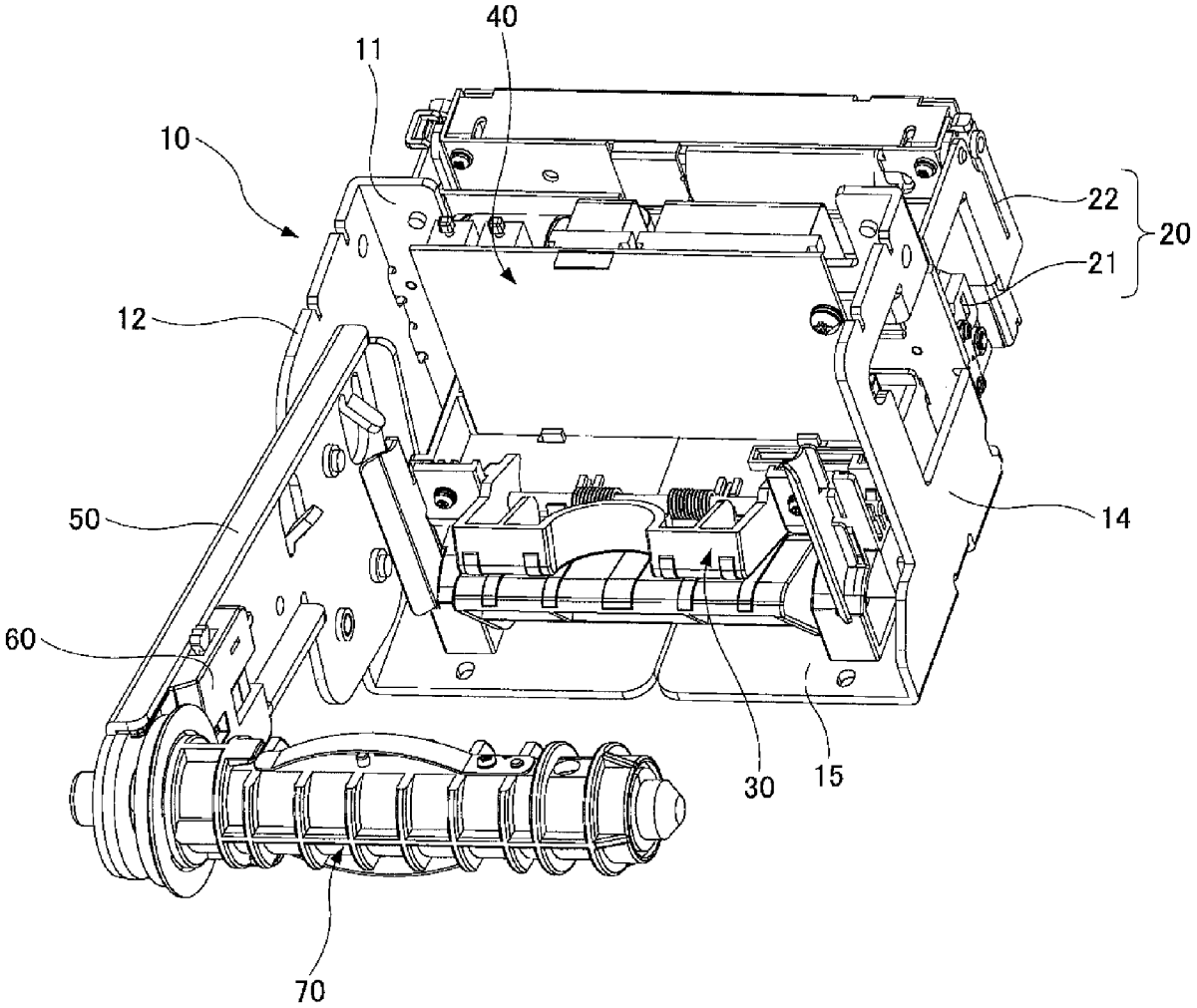
FIG. 8 is a diagram illustrating a structure of the printer according to the first embodiment.
Figure 10:
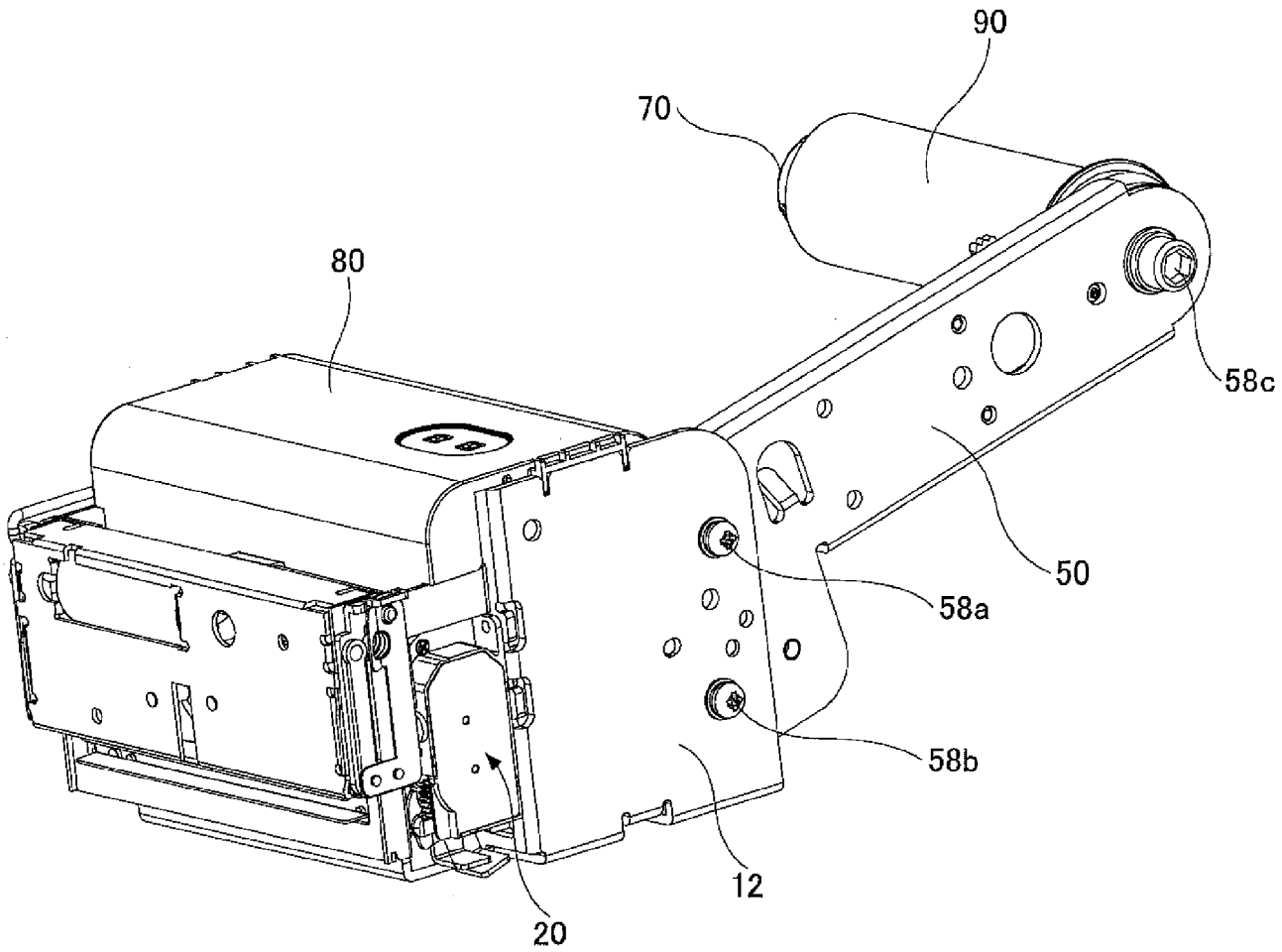
FIG. 10 is another perspective view of the printer according to the first embodiment.

Next, as illustrated in FIG. 8, the arm unit 50 is connected to the side face part 12 of the mainframe 10. Referring also to FIG. 1 and FIG. 10, the arm unit 50 is connected to the side face part 12 of the mainframe 10 by being fixed (screwed) at one end to the side face part 12 with screws 58*a* and 58*b*. Further, the paper feed shaft unit 70 is rotatably connected to the arm unit 50 at the other end with a screw 58*c*. The near-end detecting unit 60 is provided between the arm unit 50 and the paper feed shaft unit 70.

Further, the printer mechanism unit 20 is connected to the front face part 11 of the mainframe 10 on the second surface side of the front face part 11. The printer mechanism unit 20 is connected to the front face part 11 on its second surface side by being fixed (screwed) to the front face part 11 with screws 28*a* and 28*b* illustrated in, for example, FIG. 1.

Figure 9:
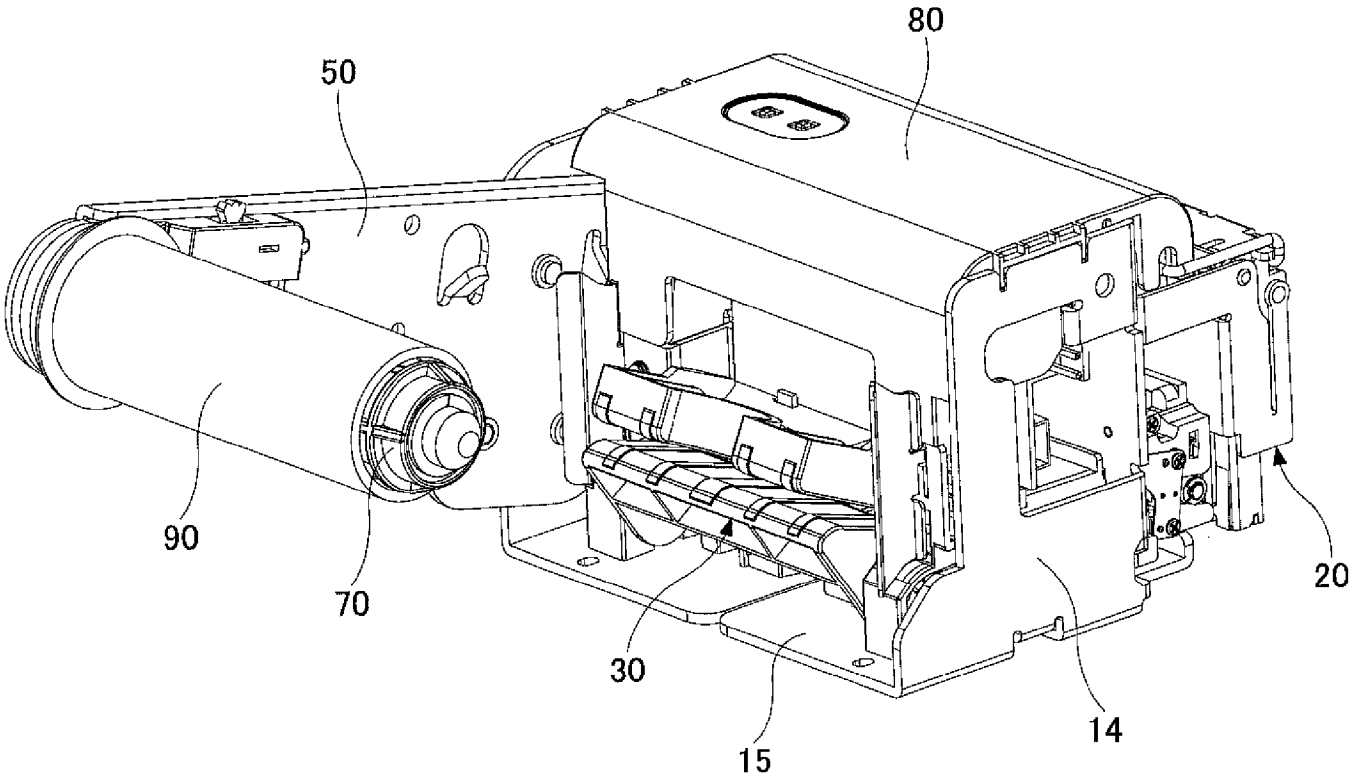
FIG. 9 is a perspective view of the printer according to the first embodiment.

FIG. 9 and FIG. 10 are perspective views of the printer unit according to this embodiment, manufactured by thus connecting the individual units. FIG. 9 and FIG. 10 illustrate the printer with recording paper 90 being attached to the paper feed shaft unit 70. FIG. 9 and FIG. 10 are a front-side perspective view and a rear-side perspective view, respectively, of the printer. According to this embodiment, the printer is a so-called single-holding type printer with the single arm unit 50, where one of the opposite ends of the paper feed shaft unit 70 is connected to the arm unit 50.

Figure 11:
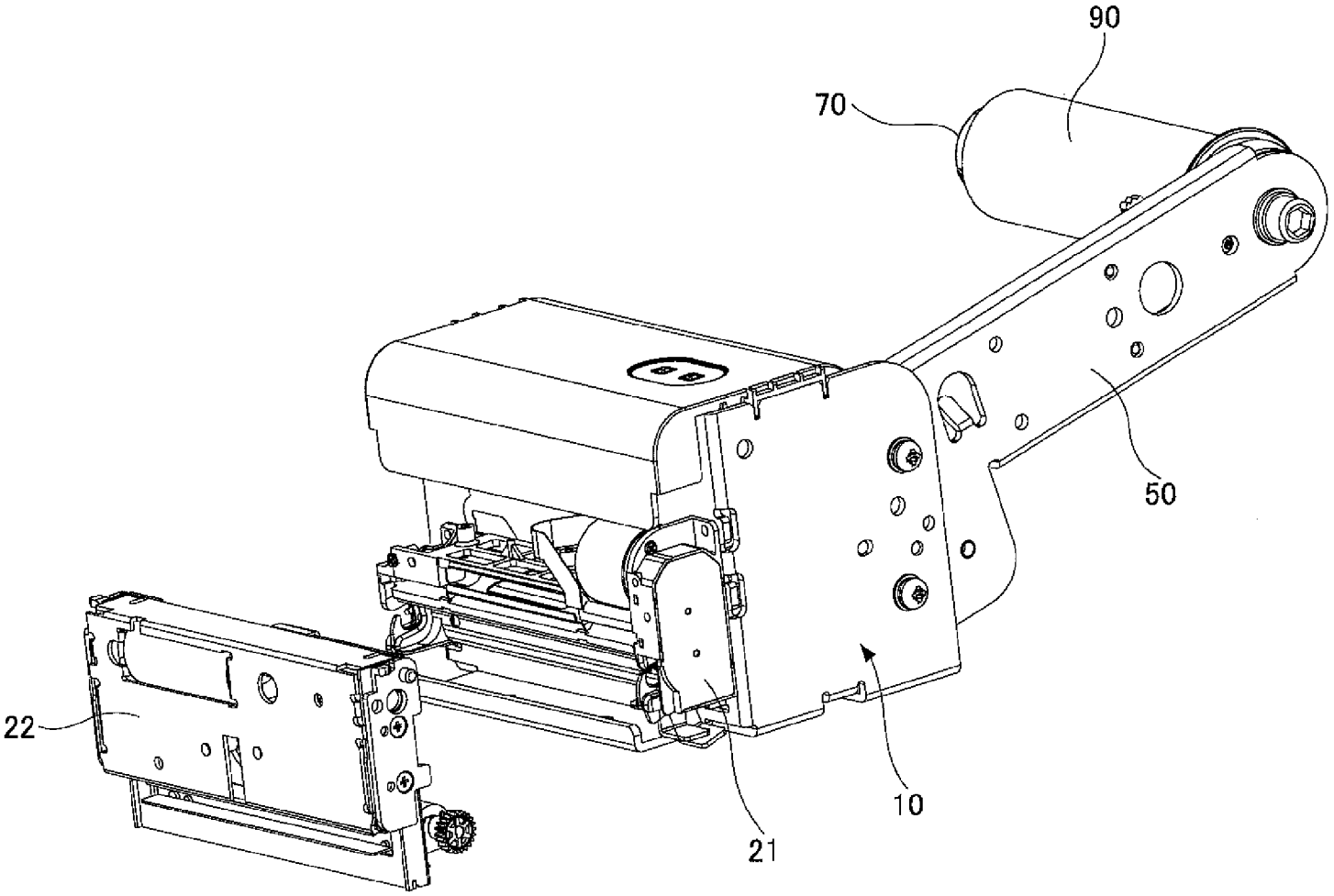
FIG. 11 is a perspective view of the printer from which a cutter unit is removed according to the first embodiment.

Further, according to the printer of this embodiment, as illustrated in FIG. 11, the printer mechanism unit 20 is easily separable into the printer unit 21 and the cutter unit 22. Therefore, the printer of this embodiment may be used as a printer even with the cutter unit 22 being disconnected.

As described above, according to this embodiment, the printer is manufactured by connecting individual units to the mainframe 10. Accordingly, different types of printers suitable for purposes of use may be easily manufactured by attaching individual units in accordance with their use. Further, since units may be replaced on a unit basis in the case of occurrence of a failure, it is possible to quickly perform maintenance work such as repairing. That is, since the printer mechanism unit 20, the recording paper guide unit 30, and the arm unit 50 are directly connected to the mainframe 10, different types of printers may be easily manufactured in accordance with use, and it is also possible to easily perform maintenance work such as repairing.

Figure 12:
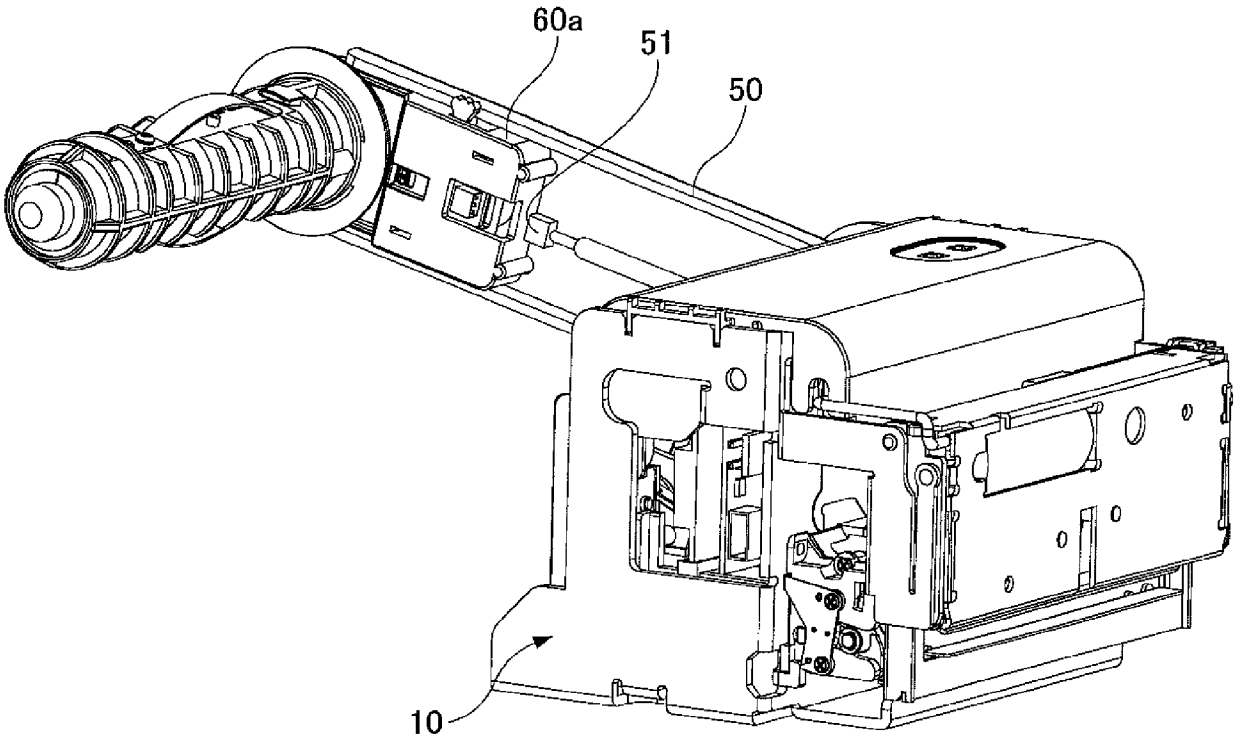
FIG. 12 is a diagram illustrating a near-end detecting unit according to the first embodiment.
Figure 13:
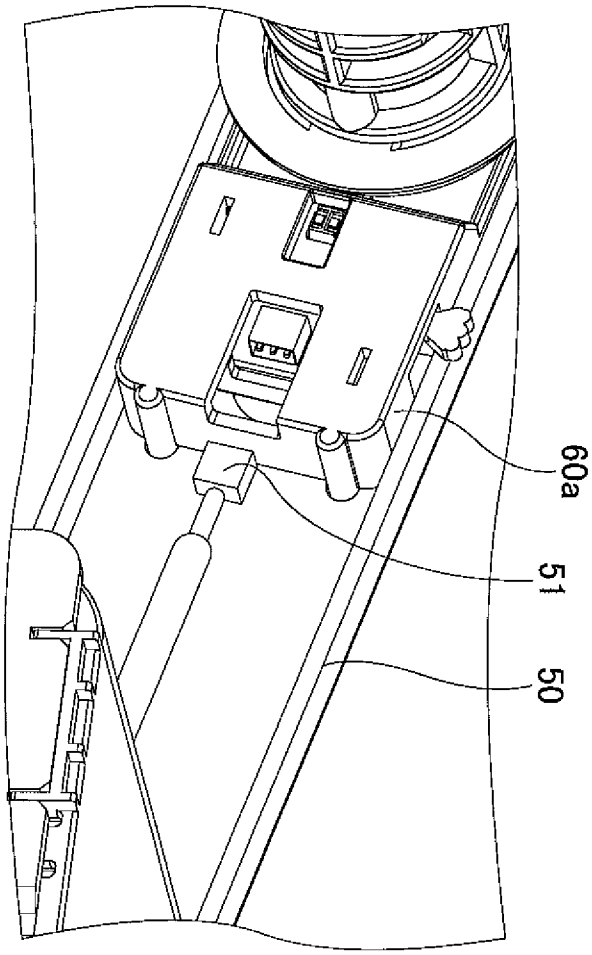
FIG. 13 is an enlarged view of part of the printer of FIG. 12 according to the first embodiment.
Figure 14:
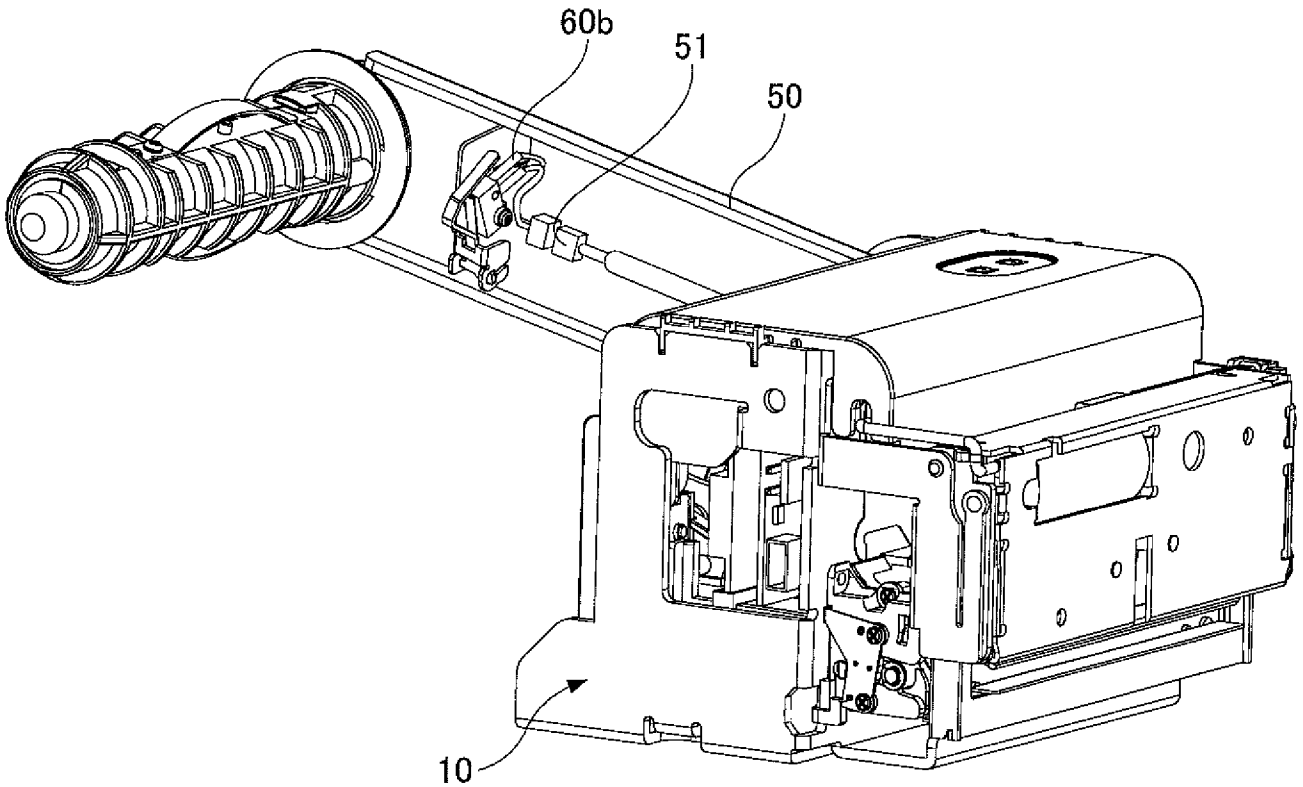
FIG. 14 is another diagram illustrating another near-end detecting unit according to the first embodiment.
Figure 15:
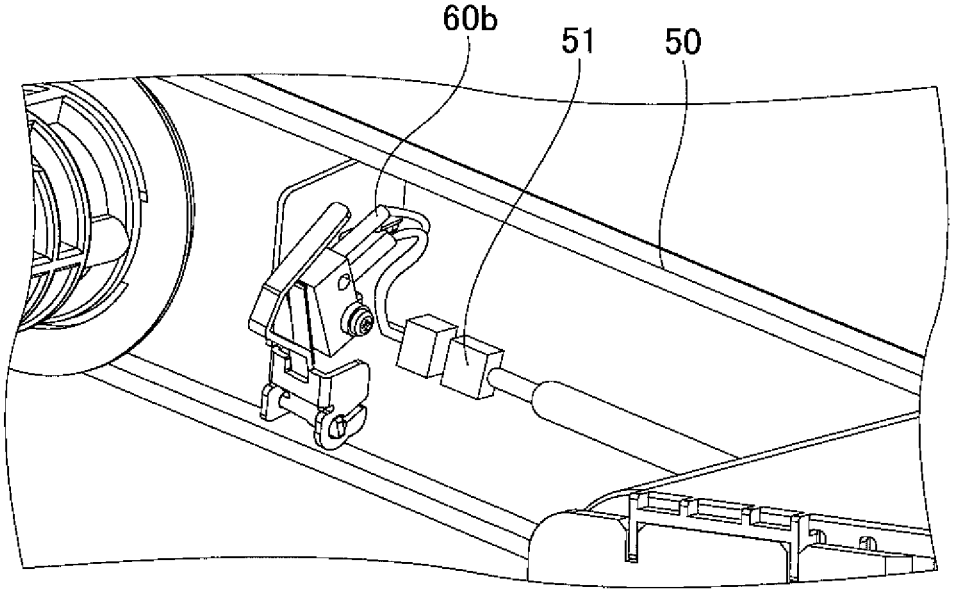
FIG. 15 is an enlarged view of part of the printer of FIG. 14 according to the first embodiment.

The printer of this embodiment allows an optical near-end detecting unit 60*a* as illustrated in FIG. 12 and FIG. 13 or a mechanical near-end detecting unit 60*b* as illustrated in FIG. 14 and FIG. 15 to be connected as the near-end detecting unit 60. The arm unit 50 includes a connection terminal part 51 connecting to the optical near-end detecting unit 60*a* or the mechanical near-end detecting unit 60*b*. The connection terminal part 51 facilitates the replacement or attachment of the near-end detecting unit 60. FIG. 13 is an enlarged view of part of the printer illustrated in FIG. 12, and FIG. 14 is an enlarged view of part of the printer illustrated in FIG. 15.

A description is given of the paper feed shaft unit 70.

First, a description is given of the rolled recording paper 90 falling off of a paper feed shaft unit 970.

Figure 16:
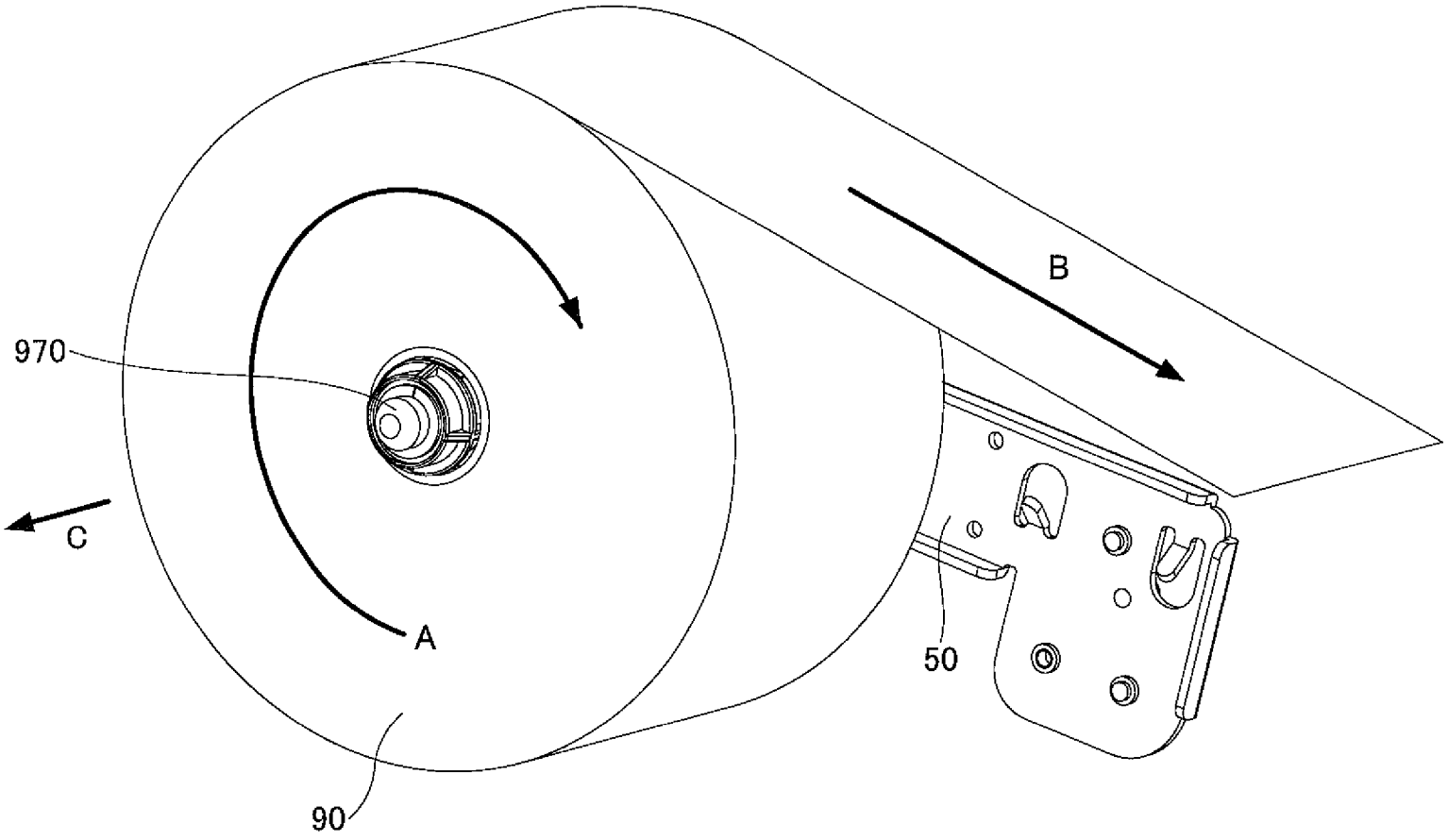
FIG.16 RELATED ART
FIG. 16 is a diagram illustrating the "falling-off" of recording paper.

As illustrated in FIG. 16, the rolled recording paper 90 rotates in a direction indicated by arrow A to be fed in a direction indicated by arrow B and subjected to printing in the printer mechanism unit 20. Therefore, the recording paper 90 rotates in the direction indicated by arrow A in each printing.

In the case of a single-holding type printer, the paper feed shaft unit 970 is held at one end by the arm unit 50. Therefore, the recording paper 90 does not fall off from the one end of the paper feed shaft unit 970. However, if no member for preventing the recording paper 90 from falling off is provided at the other end of the paper feed shaft unit 970, the recording paper 90 falls off from the other end of the paper feed shaft unit 970. That is, the recording paper 90 falls off of the paper feed shaft unit 70 in a direction indicated by arrow C.

According to the printer of this embodiment, the paper feed shaft unit 70 is so configured as to prevent the recording paper 90 from falling off from the other end (open or free end) of the paper feed shaft unit 70.

Figure 17:
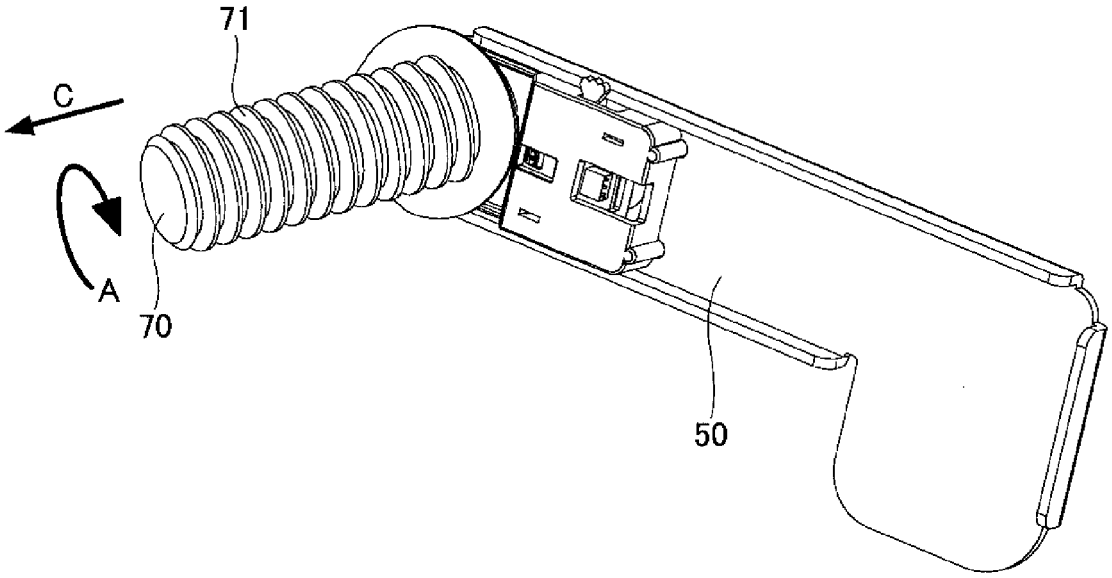
FIG. 17 is a diagram illustrating a paper feed shaft unit according to the first embodiment.

Next, a description is given, with reference to FIG. 17, of a variation of the paper feed shaft unit 70 of the printer according to this embodiment. According to the printer of this embodiment, the paper feed shaft unit 70 may be configured to have a helical projection part 71 formed on its surface. The helical projection part 71 is helically formed so as to move in the direction opposite to the direction indicated by arrow C, that is, to be directed toward the connection to the arm unit 50, when the paper feed shaft unit 70 rotates in the direction indicated by arrow A.

As a result of thus forming the helical projection part 71 that is directed toward the arm unit 50 on the surface of the paper feed shaft unit 70, when the recording paper 90 rotates in the direction indicated by arrow A to be fed, the helical projection part 71 causes the recording paper 90 to move in the direction opposite to the direction indicated by arrow C, that is, in the direction toward the connection to the arm unit 50. Therefore, with each rotation, the recording paper 90 is caused to move in the direction opposite to a direction to fall off of the paper feed shaft unit 70, that is, the direction indicated by arrow C. Therefore, it is possible to prevent the recording paper 90 from falling off of the paper feed shaft unit 70.

Thus, by forming the helical projection part 71 on the surface of the paper feed shaft unit 70, it is possible to prevent the recording paper 90 from falling off of the paper feed shaft unit 70 without an increase in cost. Further, there is no need to provide a member for preventing the recording paper 90 from falling off at the other end (unfixed or unconnected end) of the paper feed shaft unit 70. This allows the recording paper 90 to be replaced quickly and easily.

[b] Second Embodiment

Next, a description is given of a printer according to a second embodiment. A printer according to this embodiment is a so-called double-holding type printer including two arm units.

As illustrated in FIG. 18, FIG. 19, FIG. 20, and FIG. 21, a printer according to the second embodiment has the same structure as the printer of the first embodiment except that the arm unit 50 of the first embodiment is replaced with two arm units 55 and 56.

Figure 18:
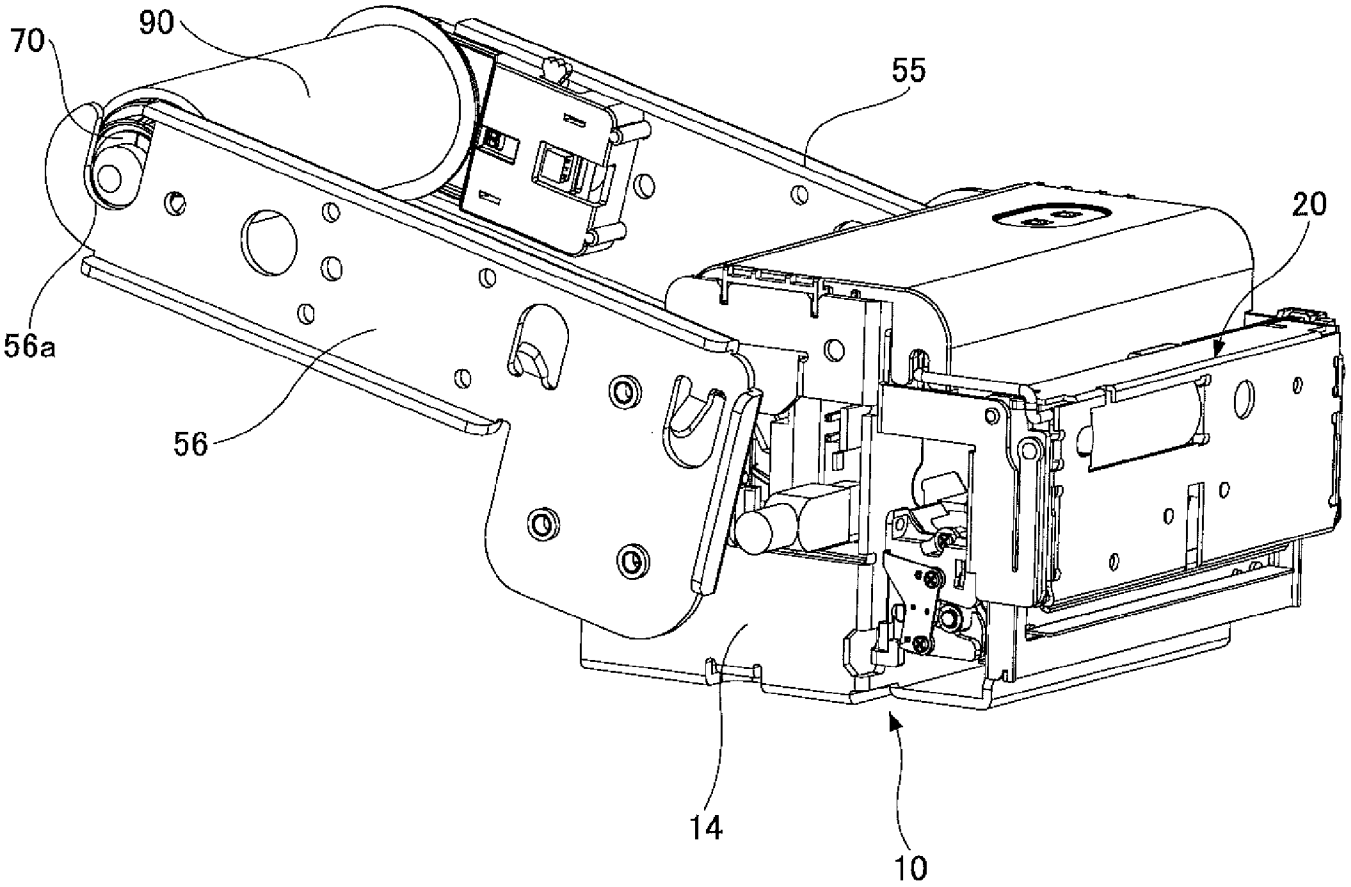
FIG. 18 is a perspective view of a printer according to a second embodiment.
Figure 19:
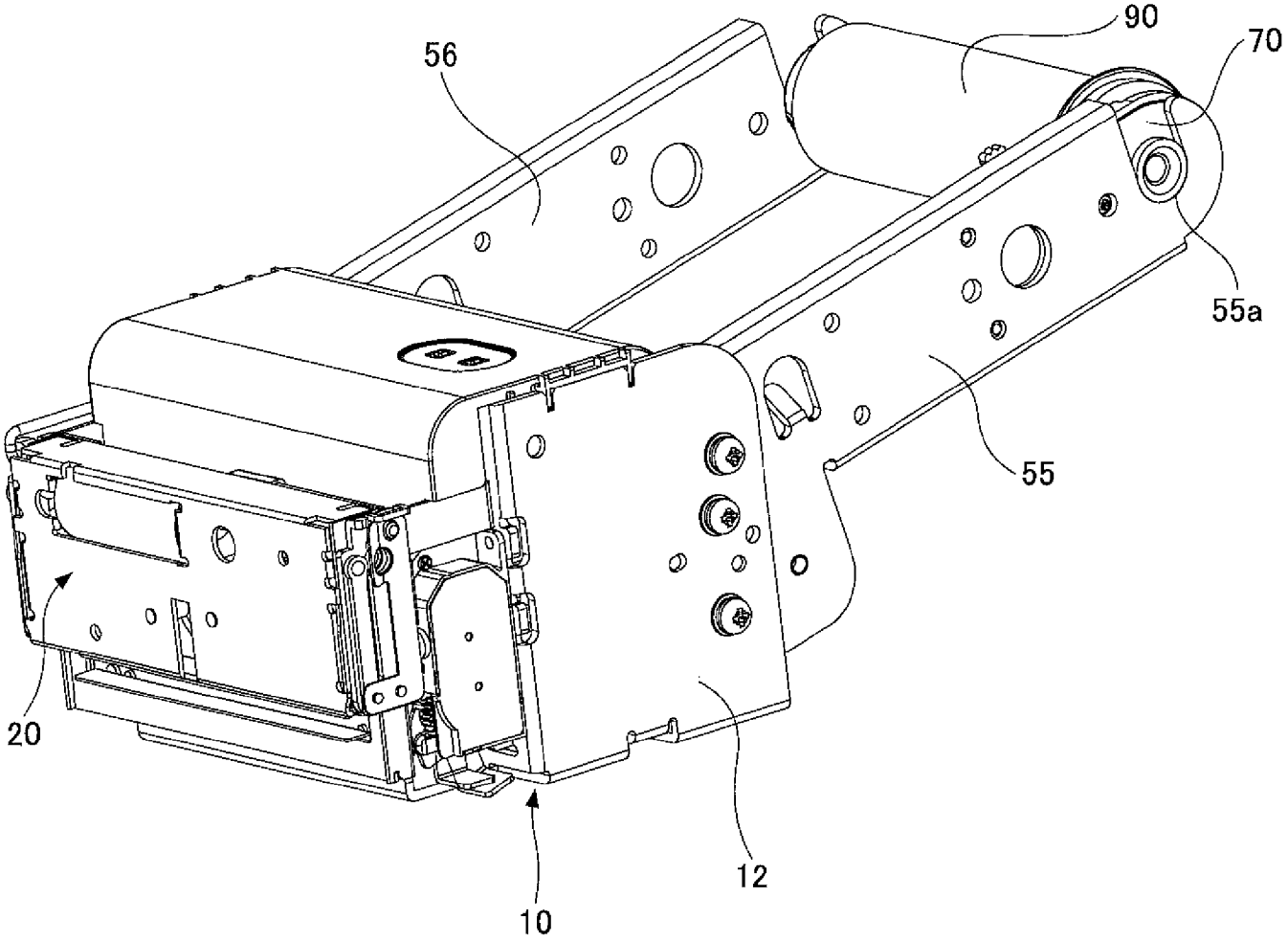
FIG. 19 is another perspective view of the printer according to the second embodiment.
Figure 20:
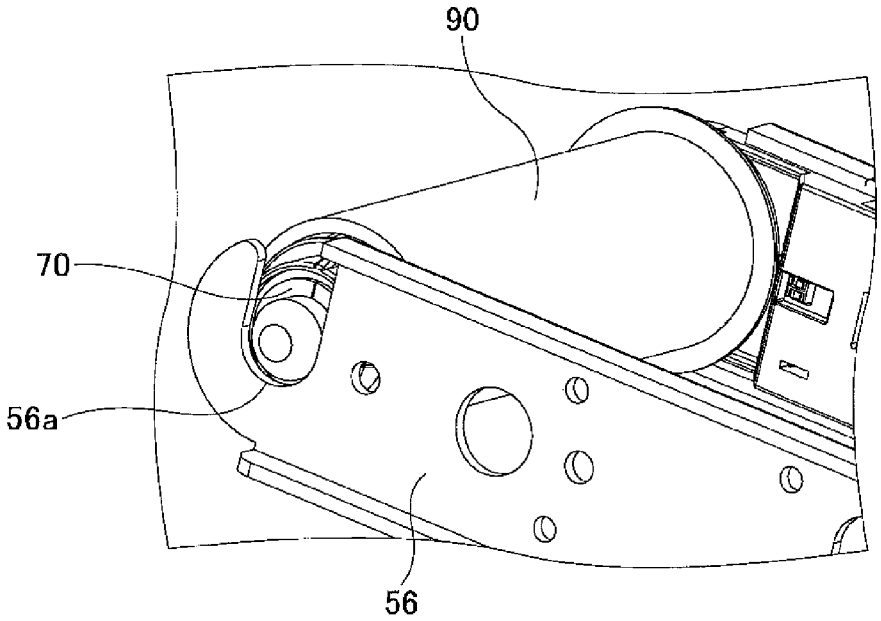
FIG. 20 is an enlarged view of part of the printer of FIG. 18 according to the second embodiment.
Figure 21:
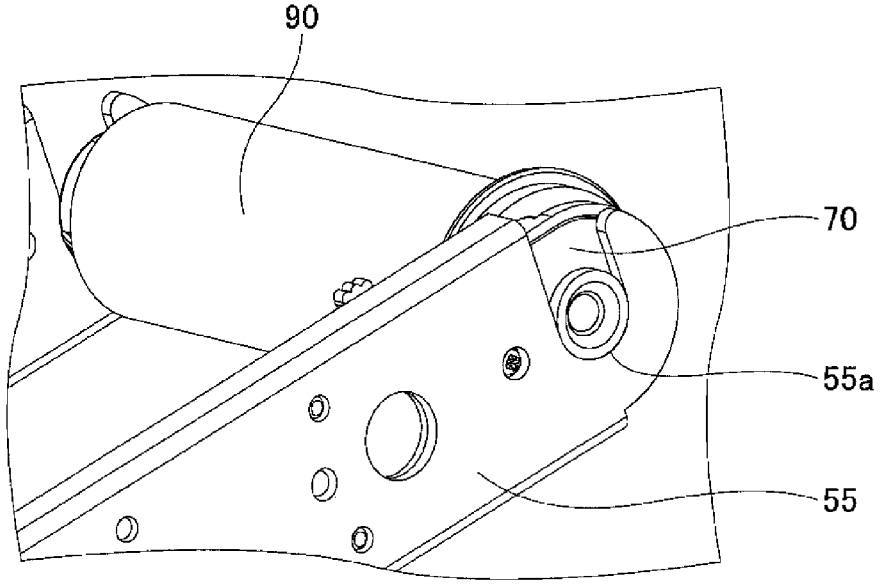
FIG. 21 is an enlarged view of part of the printer of FIG. 19 according to the second embodiment.

According to the printer of the second embodiment, the arm unit 55 is connected to the side face part 12 of the mainframe 10, and the arm unit 56 is connected to the side face part 14 of the mainframe 10. The arm unit 55 is connected at one end to the side face part 12 of the mainframe 10, and the arm unit 56 is connected at one end to the side face part 14 of the mainframe 10. The arm unit 55 has a cutout 55*a* (for example, having a U-letter shape) provided at the other end. The arm unit 56 has a cutout 56*a* (for example, having a U-letter shape) provided at the other end. The paper feed shaft unit 70 has its first and second opposite ends held in the cutout 55*a* and the cutout 56*a*, respectively. Thus, the paper feed shaft unit 70 is rotatably held by the arm units 55 and 56. FIG. 18 is a perspective view of the printer taken from the side face part 14 side. FIG. 19 is a perspective view of the printer taken from the side face part 12 side. FIG. 20 is an enlarged view of part of the printer illustrated in FIG. 18. FIG. 21 is an enlarged view of part of the printer illustrated in FIG. 19.

This embodiment allows the arm unit 50 to be changed to (replaced with) the arm units 55 and 56, thus facilitating a change from a single-holding type printer to a double-holding type printer. Further, it is possible to manufacture different types of printers, for example, a single-holding type printer and a double-holding type printer, with ease based on whether to connect the arm unit 50 or the arm units 55 and 56 to the mainframe 10, thus facilitating manufacture of different types of printers in accordance with use.

In the second embodiment, a description is given of the arm unit by way of example. However, the same is the case with other units such as the control board unit and the printer mechanism unit. By preparing and assembling multiple control board units or printer mechanism in accordance with desired specifications, it is possible to easily manufacture different types of printers in accordance with use.

[c] Third Embodiment

Figure 22:
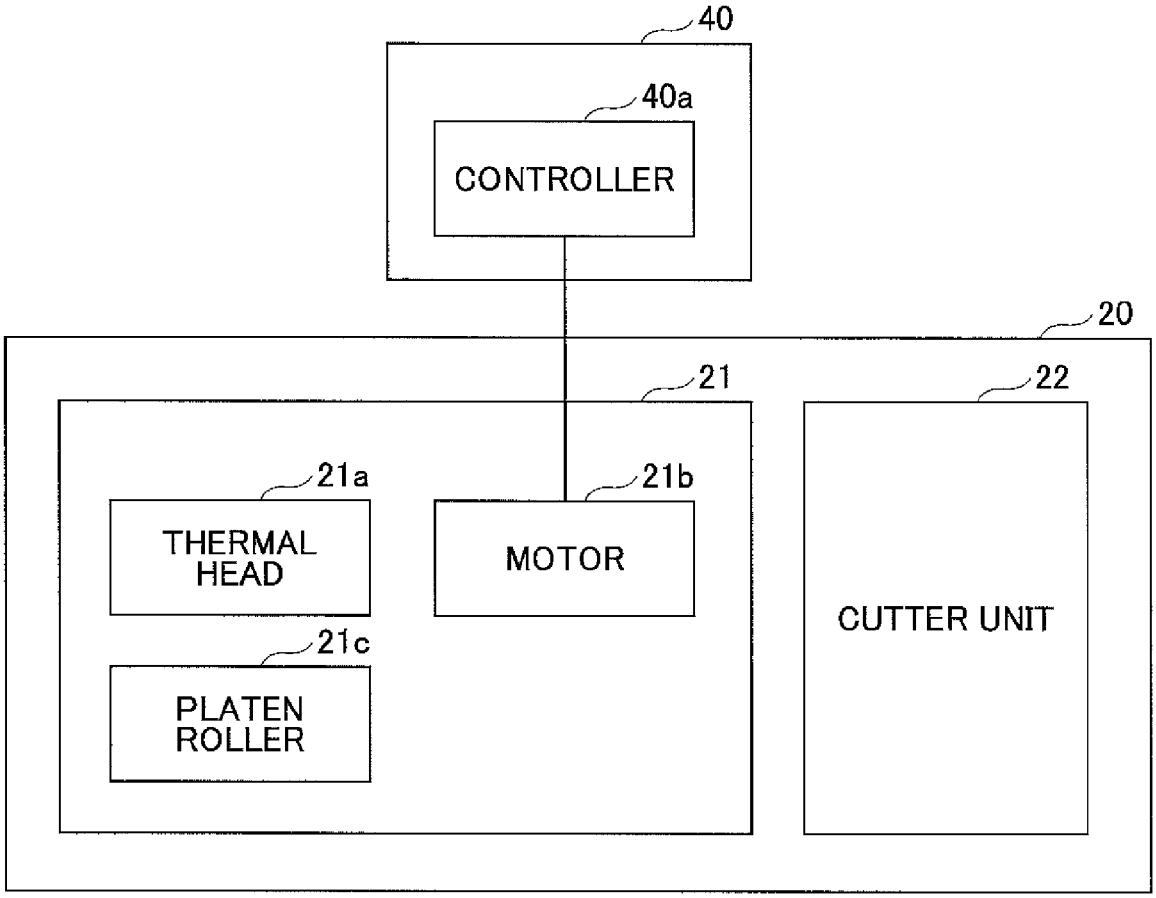
FIG. 22 is a schematic block diagram illustrating a printer mechanism unit and the control board unit according to a third embodiment.

Next, a description is given of a third embodiment. FIG. 22 is a schematic block diagram illustrating the printer mechanism unit 20 and the control board unit 40. The third embodiment is a method of controlling the motor 21*b* provided in the printer mechanism unit 20. The motor 21*b* is controlled by a controller 40*a* including a processor such as a central processing unit (CPU) in the control board unit 40.

Figure 23A:
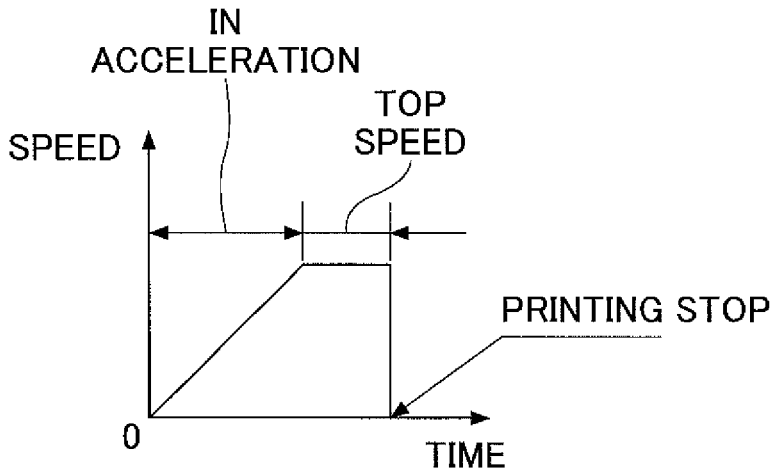
FIG.23A RELATED ART
FIGS. 23A and 23B are diagrams illustrating a slack in recording paper in a conventional printer.
Figure 23B:
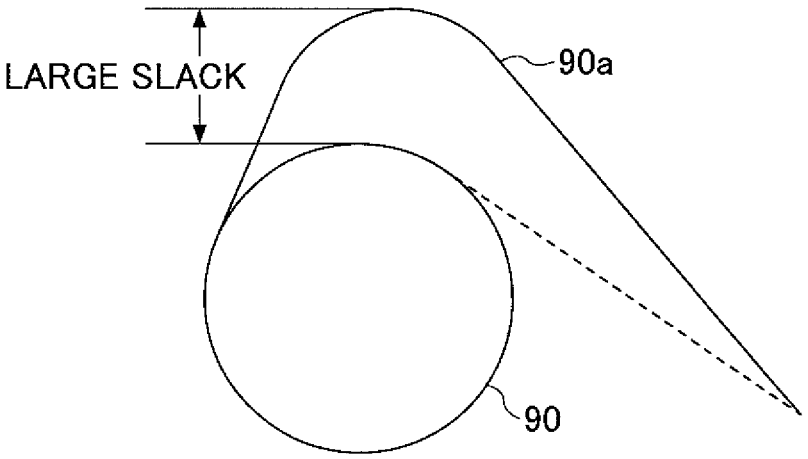
FIG.23B RELATED ART

In the case where the motor 21*b* provided in the printer unit 21 of the printer mechanism unit 20 is controlled so that the recording paper 90 is conveyed at a constant speed after the acceleration of its conveyance, and the conveyance of the recording paper 90 is stopped at the same time that printing on the recording paper 90 is stopped as illustrated in FIG. 23A, a large slack is caused in an outer portion 90*a* of the rolled recording paper 90 as illustrated in FIG. 23B.

Figure 24A:
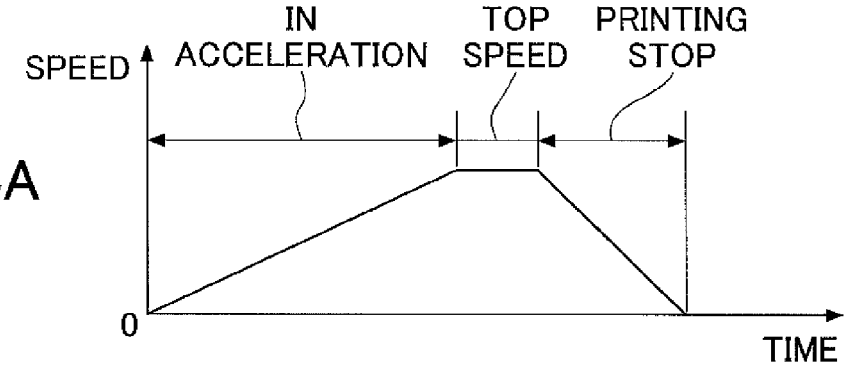
FIGS. 24A and 24B are diagrams illustrating a slack in recording paper in a printer according to the third embodiment.
Figure 24B:
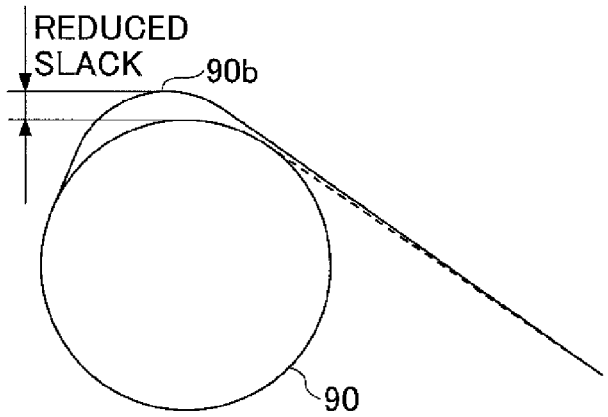

According to a printer of the third embodiment, such a slack of recording paper is reduced. For example, as illustrated in FIG. 24A, the recording paper 90 is conveyed at a constant speed after the acceleration of its conveyance, and the speed at which the recording paper 90 is conveyed by the motor 21*b* is gradually reduced in accordance with the stoppage of printing. By thus controlling the motor 21*b* provided in the printer unit 21 with the controller 40*a* of the control board unit 40, it is possible to reduce a slack in an outer portion 90*b* of the rolled recording paper 90 as illustrated in FIG. 24B.

[d] Fourth Embodiment

Next, a description is given of a fourth embodiment. A printer according to the fourth embodiment includes a paper feed shaft unit different in structure from the paper feed shaft unit 70 of the printer according to the first embodiment. The printer of the fourth embodiment has the same structure as the printer of the first embodiment except for the paper feed shaft unit.

Figure 25:
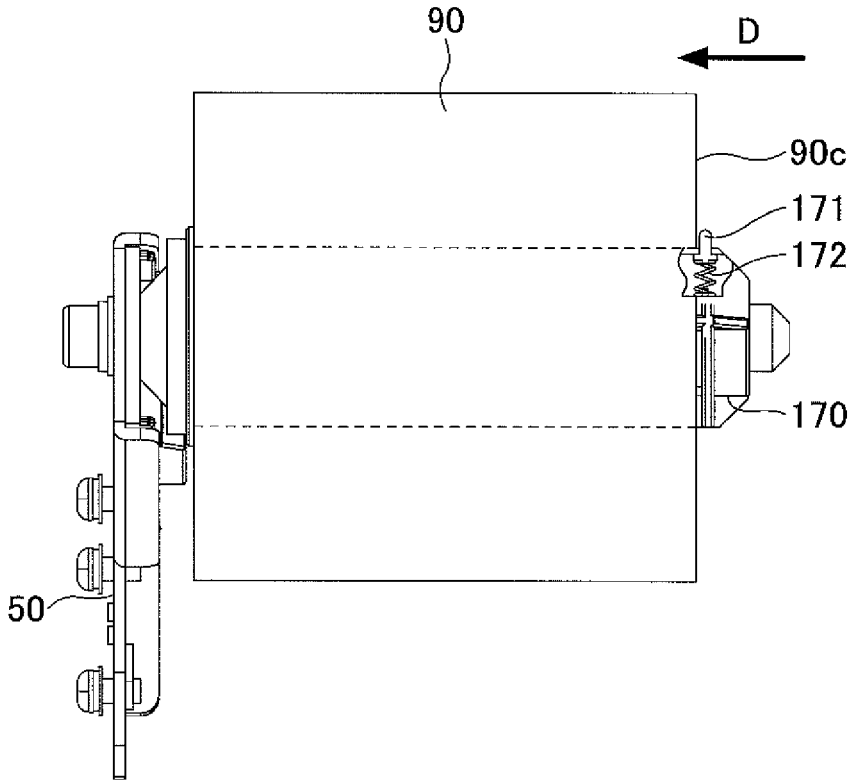
FIG. 25 is a diagram illustrating a paper feed shaft unit of a printer according to a fourth embodiment.
Figure 26:
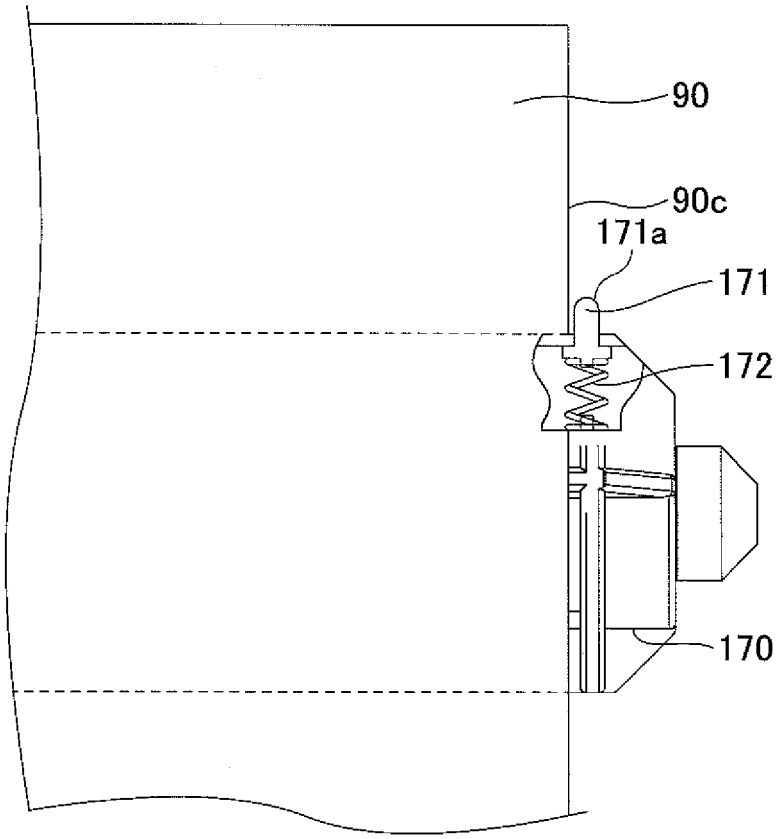
FIG. 26 is an enlarged view of part of FIG. 25 according to the fourth embodiment.

A description is given, with reference to FIG. 25 and FIG. 26, of a paper feed shaft unit 170 used in the printer according to the fourth embodiment. FIG. 25 is a diagram illustrating the paper feed shaft unit 170. FIG. 26 is an enlarged view of part of FIG. 25. The paper feed shaft unit 170 has a first end portion rotatably connected to the arm unit 50, and has a pin 171 and a spring 172 for pushing the pin 171 (radially) outward that are provided at a second end portion. The pin 171 is so provided as to be across the recording paper 90 from the arm unit 50, that is, outside an end portion 90*c* of the recording paper 90, which is on the side opposite to the side on which the paper feed shaft unit 170 is connected to the arm unit 50, with the recording paper 90 being attached to the paper feed shaft unit 170. Therefore, with the recording paper 90 being attached to the paper feed shaft unit 170, even if the recording paper 90 moves in a direction to fall off of the paper feed shaft unit 170, the pin 171 holds the end portion 90*c* of the recording paper 90 to prevent the recording paper 90 from falling off of the paper feed shaft unit 170.

Further, the pin 171 has a rounded end 171*a* (FIG. 26). When the recording paper 90 is attached to the paper feed shaft unit 170 in a direction indicated by arrow D, the rounded end 171*a* of the pin 171 is pressed by the inner wall surface of the recording paper roll (recording paper 90) exposed in its center opening, so that the pin 171 compresses the spring 172 to move toward the rotation axis of the paper feed shaft unit 170 into the paper feed shaft unit 170. With the recording paper 90 being completely attached to the paper feed shaft unit 170, the pin 171 is positioned outside the end portion 90*c* of the recording paper 90, so that the pin 171 is caused to move up by the resilience of the spring 172. As a result, the pin 171 holds the end portion 90*c* of the recording paper 90 to prevent the recording paper 90 from falling off of the paper feed shaft unit 170.

Figure 27:
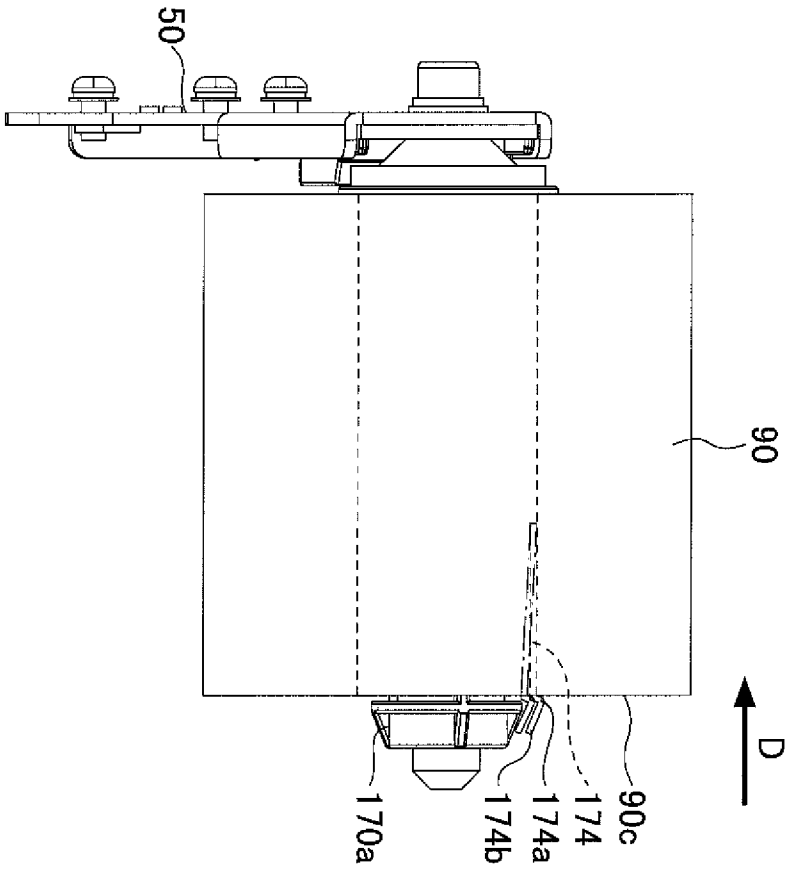
FIG. 27 is a diagram illustrating another paper feed shaft unit of the printer according to the fourth embodiment.
Figure 28:
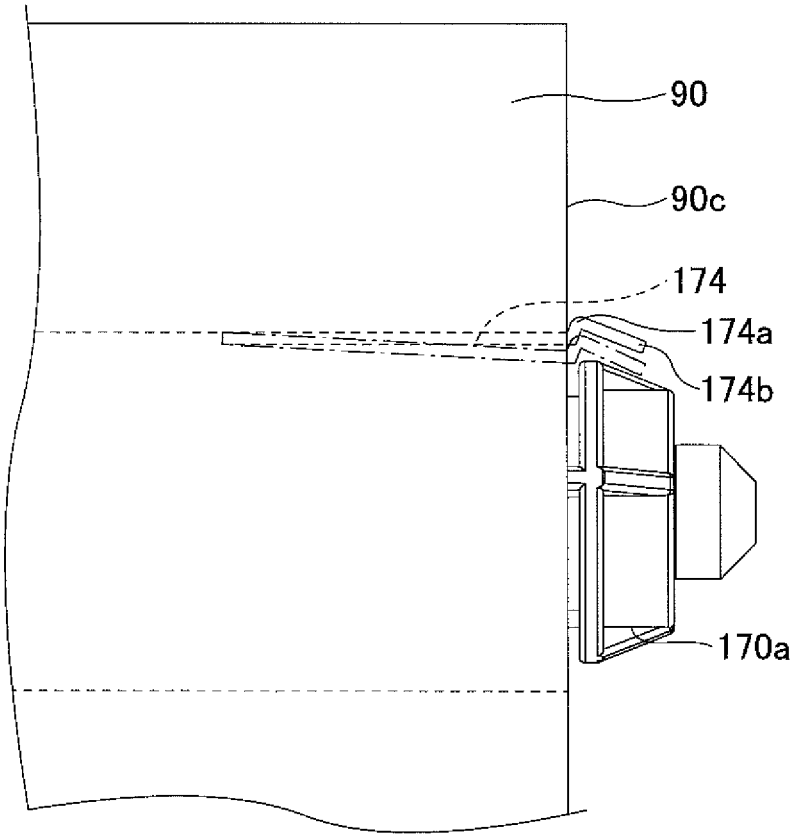
FIG. 28 is an enlarged view of part of FIG. 27 according to the fourth embodiment.

Further, as illustrated in FIG. 27 and FIG. 28, the printer according to this embodiment may include a paper feed shaft unit 170*a* that has a first end portion rotatably connected to the arm unit 50 and has a leaf spring 174 provided at a second end portion. FIG. 27 is a diagram illustrating the paper feed shaft unit 170*a*. FIG. 28 is an enlarged view of part of FIG. 27. The leaf spring 174 is formed of a material having a spring characteristic, such as a metal material. The leaf spring 174 includes a projecting part 174*a* so positioned as to be across the recording paper 90 from the arm unit 50, that is, outside the end portion 90*c* of the recording paper 90, with the recording paper 90 being attached to the paper feed shaft unit 170*a*.

The leaf spring 174 further includes a slope part 174*b* sloping toward the center of the paper feed shaft unit 170*a*. The slope part 174*b* is positioned outside the projecting part 174*a* (to define a free or open end of the leaf spring 174). Accordingly, at the time of attaching the recording paper 90 to the paper feed shaft unit 170*a* in the direction indicated by arrow D, first, the slope part 174*b* enters the center opening of the recording paper roll (recording paper 90), and thereafter, the projecting part 174*a* is pressed by the inner wall surface of the recording paper roll exposed in its center opening, so that the projecting part 174*a* is displaced toward the center of the paper feed shaft unit 170*a* because of the spring characteristic of the leaf spring 170. (The position of the projecting part 174*a* and the slope part 174*b* of the leaf spring 174 at this time is indicated by a one dot chain line in FIG. 27 and FIG. 28.) With the recording paper 90 being completely attached to the paper feed shaft unit 170*a*, the projecting part 174*a* of the leaf spring 174 is exposed (positioned) outside the end portion 90*c* of the recording paper 90 to return to its original position because of the resilience of the leaf spring 174. (The position of the projecting part 174*a* and the slope part 174*b* of the leaf spring 174 at this time is indicated by a solid line in FIG. 27 and FIG. 28.) As a result, the projecting part 174*a* holds the end portion 90*c* of the recording paper 90 to prevent the recording paper 90 from falling off of the paper feed shaft unit 170*a*.

Figure 29:
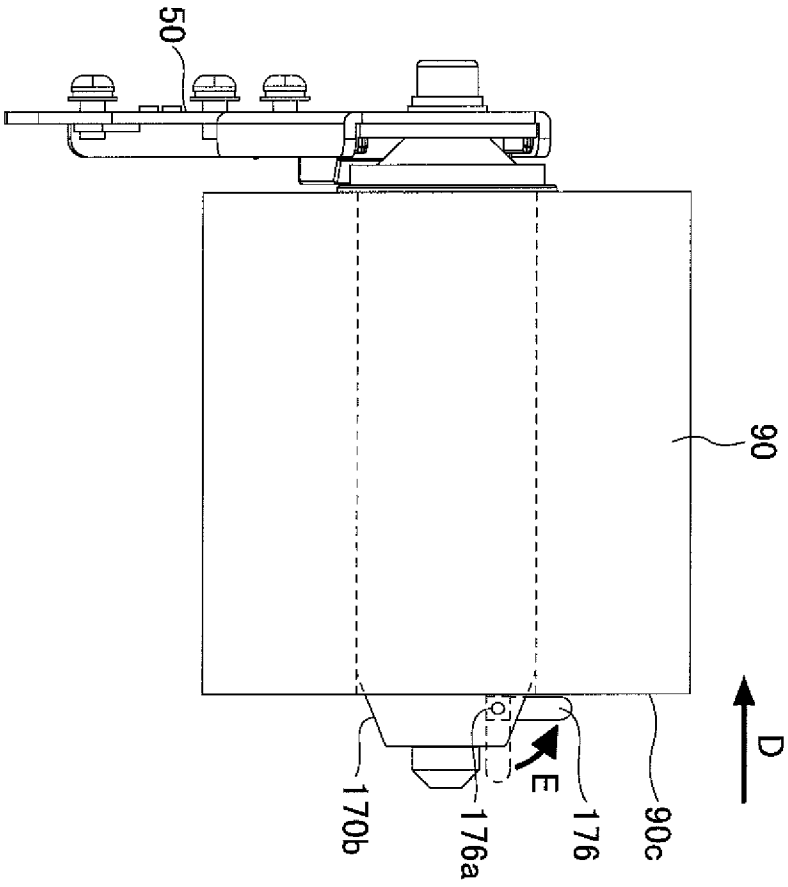
FIG. 29 is a diagram illustrating another paper feed shaft unit of the printer according to the fourth embodiment.
Figure 30:
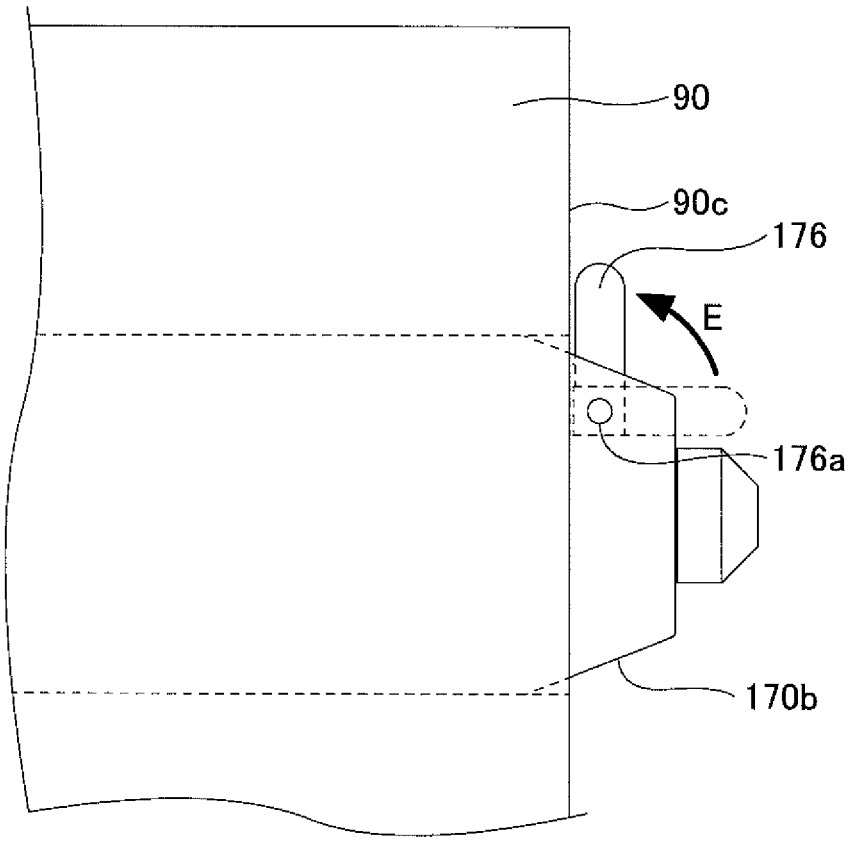
FIG. 30 is an enlarged view of part of FIG. 29 according to the fourth embodiment.

Further, as illustrated in FIG. 29 and FIG. 30, the printer according to this embodiment may include a paper feed shaft unit 170*b* that has a first end portion rotatably connected to the arm unit 50 and has a pin 176 provided at a second end portion. FIG. 29 is a diagram illustrating the paper feed shaft unit 170*b*. FIG. 30 is an enlarged view of part of FIG. 29. The pin 176 is so attached to the paper feed shaft unit 170*b* as to be turnable on a shaft 176*a*. The pin 176 is so provided as to be positioned outside the end portion 90*c* of the recording paper 90 with the recording paper 90 being attached to the paper feed shaft unit 170*b*. A spring (not graphically illustrated) is connected to the pin 176 so that a force is exerted on the pin 176 in a direction indicated by arrow E by the resilience of the spring.

At the time of attaching the recording paper 90 to the paper feed shaft unit 170*b* in the direction indicated by arrow D, the pin 176 is moved to be oriented so that the lengthwise direction of the pin 176 is substantially parallel to the lengthwise direction of the paper feed shaft unit 170*b* as indicated by a broken line in FIG. 29 and FIG. 30, and the recording paper 90 is then attached to the paper feed shaft unit 170*b*. With the recording paper 90 being completely attached to the paper feed shaft unit 170*b*, the pin 176 is exposed outside the end portion 90*c* of the recording paper 90. Therefore, the pin 176 is caused to move (turn) on the shaft 176*a* by the resilience of the spring (not graphically illustrated) to return to its original position (indicated by a solid line in FIG. 29 and FIG. 30). As a result, the pin 176 holds the end portion 90*c* of the recording paper 90 to prevent the recording paper 90 from falling off of the paper feed shaft unit 170*b*.

The fourth embodiment may be the same as the first embodiment except for the configuration described above.

[e] Fifth Embodiment

Next, a description is given of a fifth embodiment. A printer according to this embodiment employs an arm unit and a paper feed shaft unit that are different in structure from the arm unit 50 and the paper feed shaft unit 70, respectively, of the printer of the first embodiment.

Figure 31:
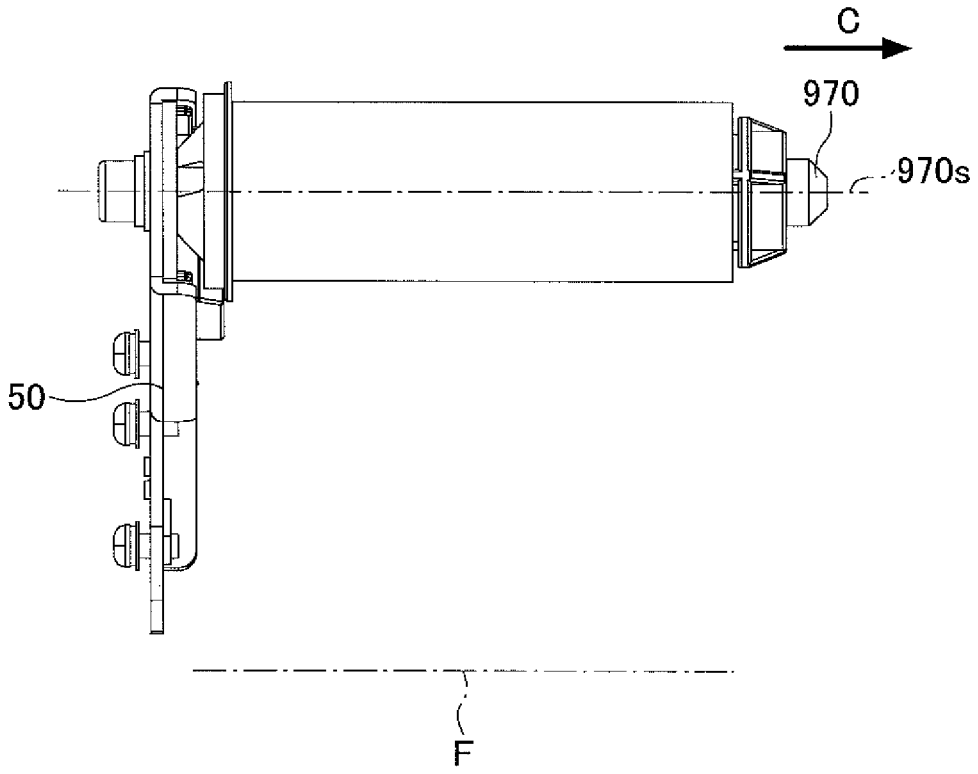
FIG.31 RELATED ART
FIG. 31 is a diagram illustrating the "falling-off" of recording paper.
Figure 32:
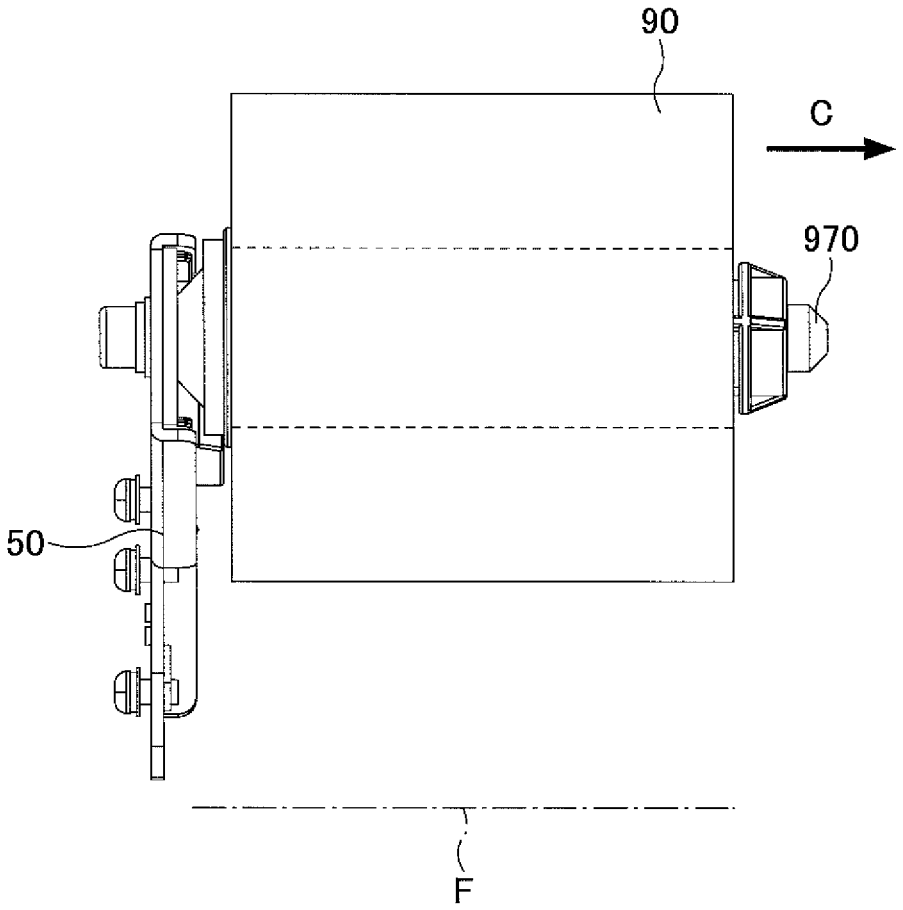
FIG.32 RELATED ART
FIG. 32 is another diagram illustrating the "falling-off" of recording paper.

As illustrated in FIG. 31, conventionally, the paper feed shaft unit 970 is connected to the arm unit 50 so that a central axis 970*s* of the paper feed shaft unit 970 is substantially parallel to a horizontal plane indicated by a one dot chain line F (a plane perpendicular to a direction of gravity). Therefore, if the recording paper 90 rotates with the recording paper 90 being attached to the paper feed shaft unit 970 as illustrated in FIG. 32, the recording paper 90 may fall off of the paper feed shaft unit 970 in the direction indicated by arrow C.

Figure 33:
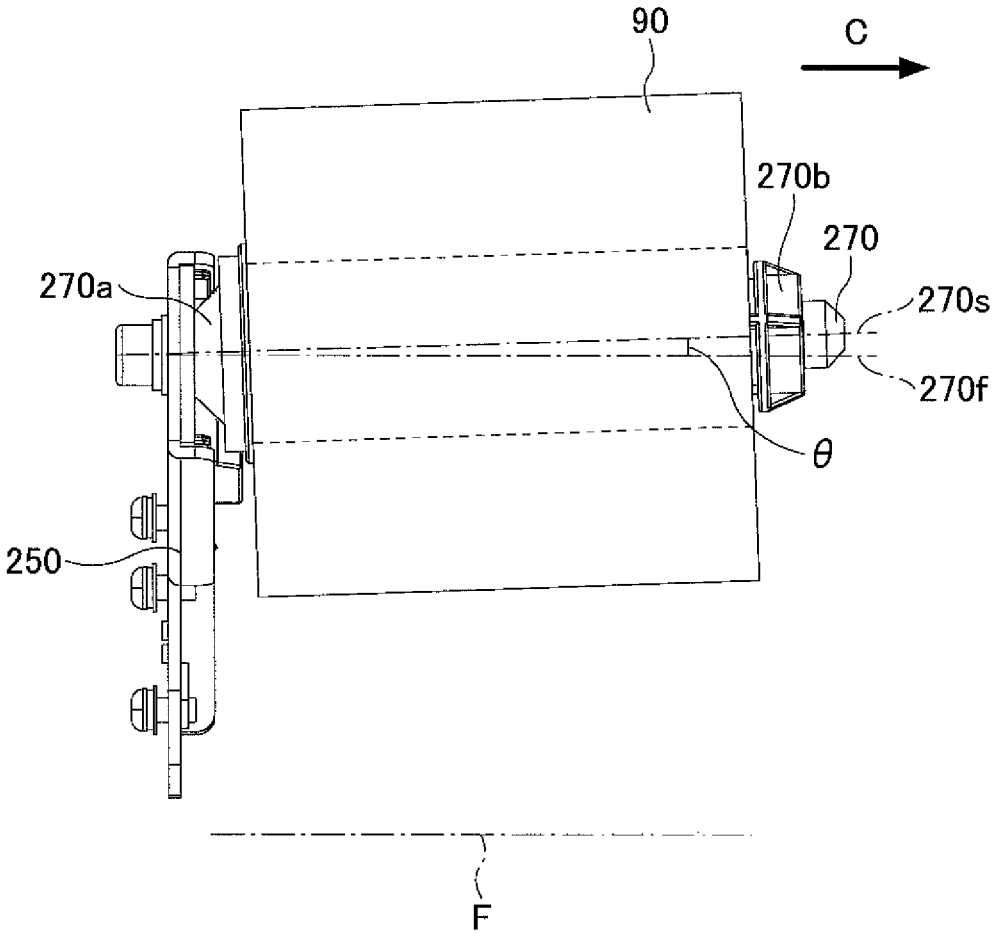
FIG. 33 is a diagram illustrating a printer according to a fifth embodiment.

According to the printer of this embodiment, as illustrated in FIG. 33, a paper feed shaft unit 270 has a first end portion 270*a* connected to an arm unit 250 and a second end portion 270*b*. The paper feed shaft unit 270 is attached to the arm unit 250 so that the second end portion 270*b* is at a vertical position higher than the vertical position of the first end portion 270*a*. For example, the paper feed shaft unit 270 is connected to the arm unit 250 with the central axis 270*s* of the paper feed shaft unit 270 and an axis (line) 270*f* parallel to the horizontal plane indicated by the broken line F, which pass through the connection of the arm unit 250 and the paper feed shaft 270, being vertically inclined a predetermined angle θ relative to each other. That is, the central axis 270*s* is inclined upward the predetermined angle θ relative to the line 270*f* with the predetermined angle θ being formed by the central axis 270*s* and the line 270*f* sharing the connection of the arm unit 250 and the paper feed shaft 270 as a common endpoint (or the vertex of the predetermined angle θ).

Attaching the recording paper 90 to the above-described paper feed shaft unit 270 causes the recording paper 90 to be higher on the side of the second end portion 270*b* of the paper feed shaft unit 270 than on the side of the first end portion 270*a* of the paper feed shaft unit 270. Therefore, when the recording paper 90 rotates, the recording paper 90 is pressed toward the side of the first end portion 270*a* where the arm unit 250 and the paper feed shaft unit 270 are connected because of gravity on the recording paper 90.

Therefore, even when the recording paper 90 rotates, it is possible to prevent the recording paper 90 from falling off of the paper feed shaft unit 270.

The fifth embodiment may be the same as the first embodiment except for the configuration described above.

[f] Sixth Embodiment

Next, a description is given of a sixth embodiment. A printer according to this embodiment allows attachment of two paper feed shaft units (to the single printer), thereby making it possible to load two recording paper rolls.

Figure 34:
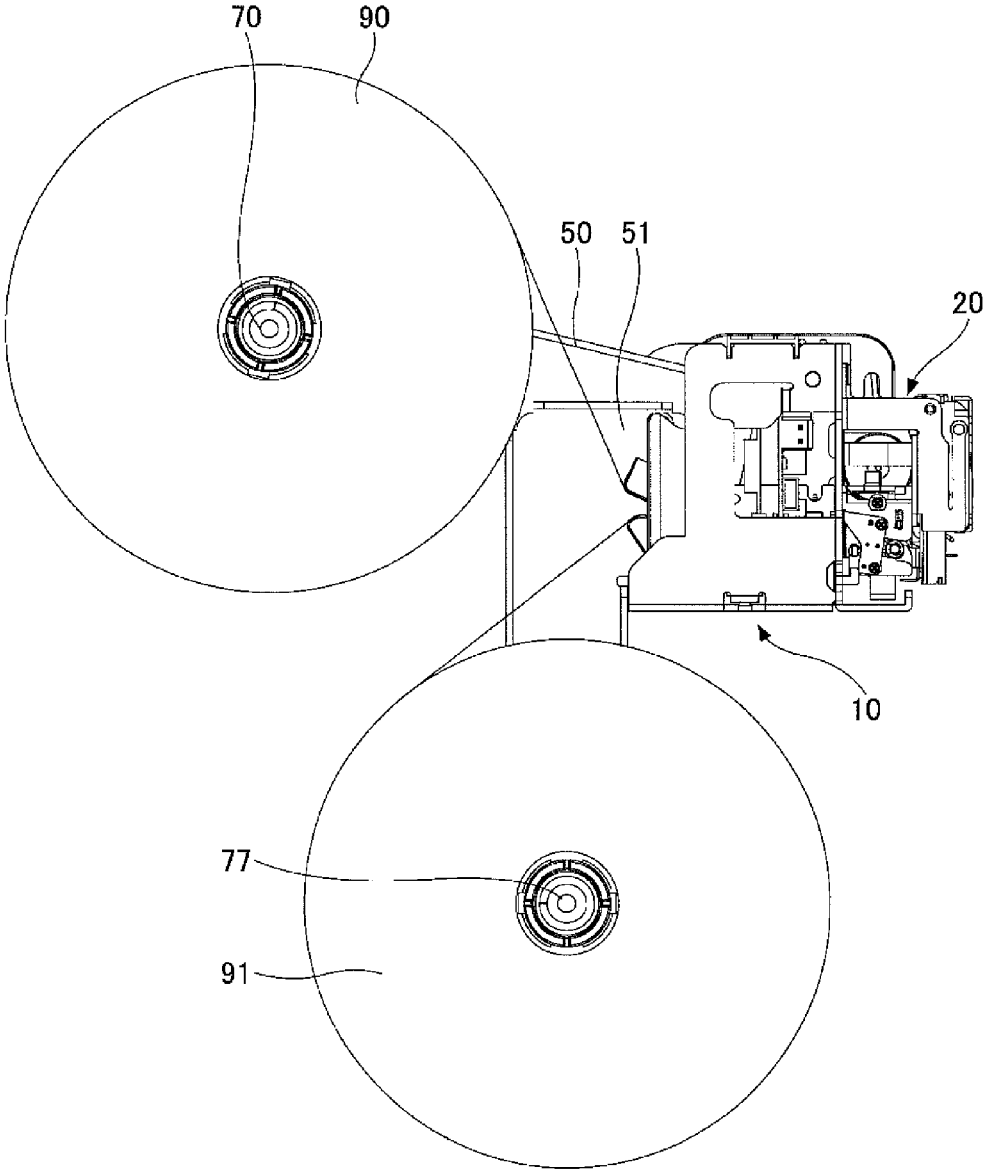
FIG. 34 is a diagram illustrating a structure of a printer loaded with two rolls of recording paper according to a sixth embodiment.
Figure 35:
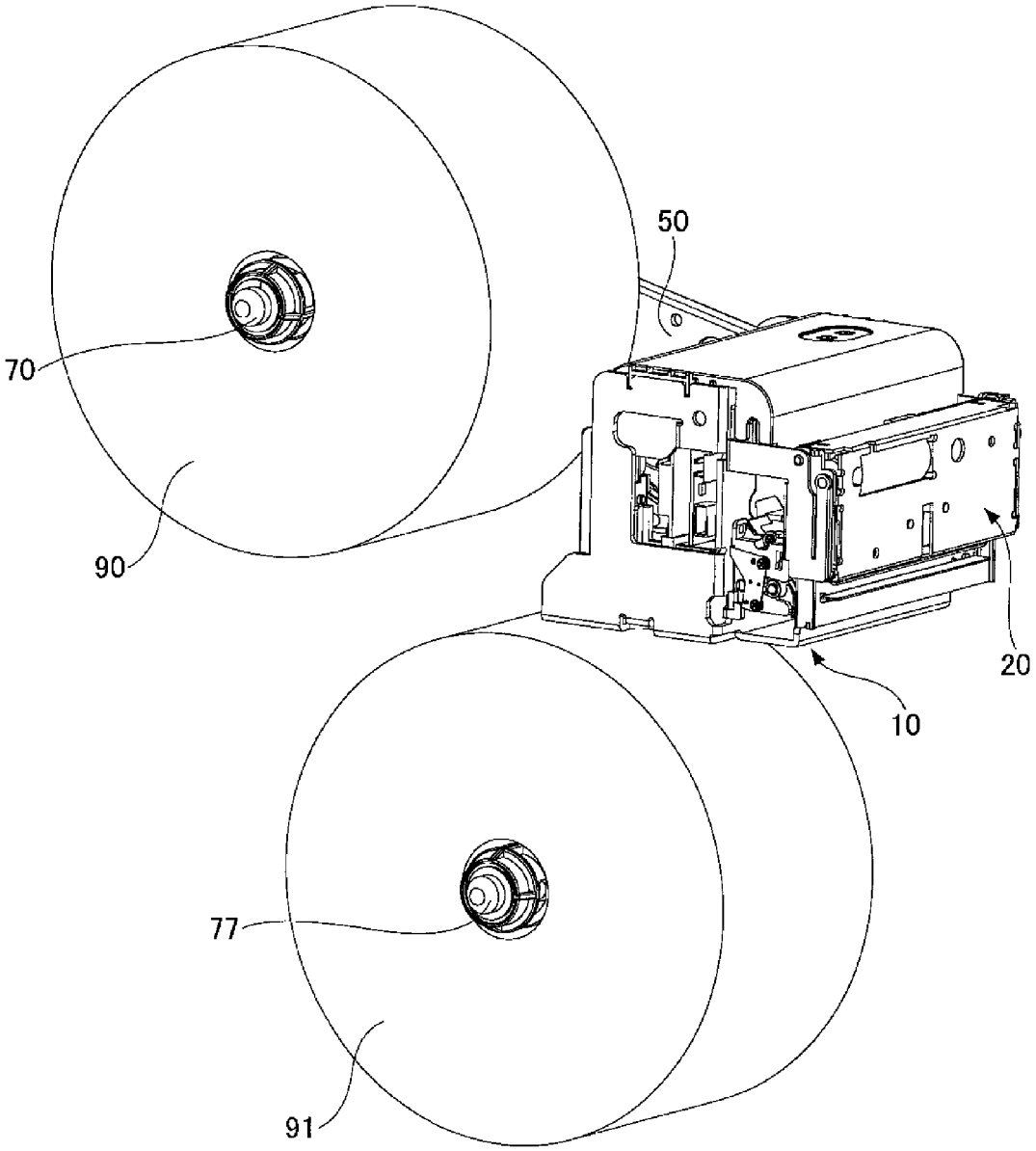
FIG. 35 is a perspective view of the printer loaded with the two rolls of recording paper according to the sixth embodiment.

For example, as illustrated in FIG. 34 and FIG. 35, the arm unit 50 and an additional arm unit 51 are connected to the mainframe 10 in order to allow connection of two paper feed shaft units, that is, the paper feed shaft unit 70 and an additional paper feed shaft unit 77. The rolled recording paper 90 is attached to the paper feed shaft unit 70, and rolled (a roll of) recording paper 91 is attached to the paper feed shaft unit 77. According to this embodiment, the single printer may be loaded with the two rolls of recording paper 90 and 91. Therefore, by incorporating a switch part as illustrated in, for example, Japanese Laid-Open Patent Application No. 2006-56032, it is possible to start printing on the recording paper 91 immediately after the recording paper 90 finishes. This eliminates inconvenience with the printer, such as the inability to perform printing until the next roll of recording paper is attached after the printer runs out of recording paper.

The recording paper 90 is supplied by attaching a new roll of recording paper when no printing is performed on the recording paper 91 after the recording paper 90 finishes. This allows the attachment of the recording paper 90 without hindering printing on the recording paper 91. Likewise, when the recording paper 91 finishes, a new roll of recording paper is attached when no printing is performed on the recording paper 90.

Thus, according to this embodiment, even when a roll, of recording paper finishes, printing may be performed on another roll of recording paper. Therefore, it is possible to reduce time in which printing is not performable and therefore to smoothly perform printing on recording paper.

Figure 36:
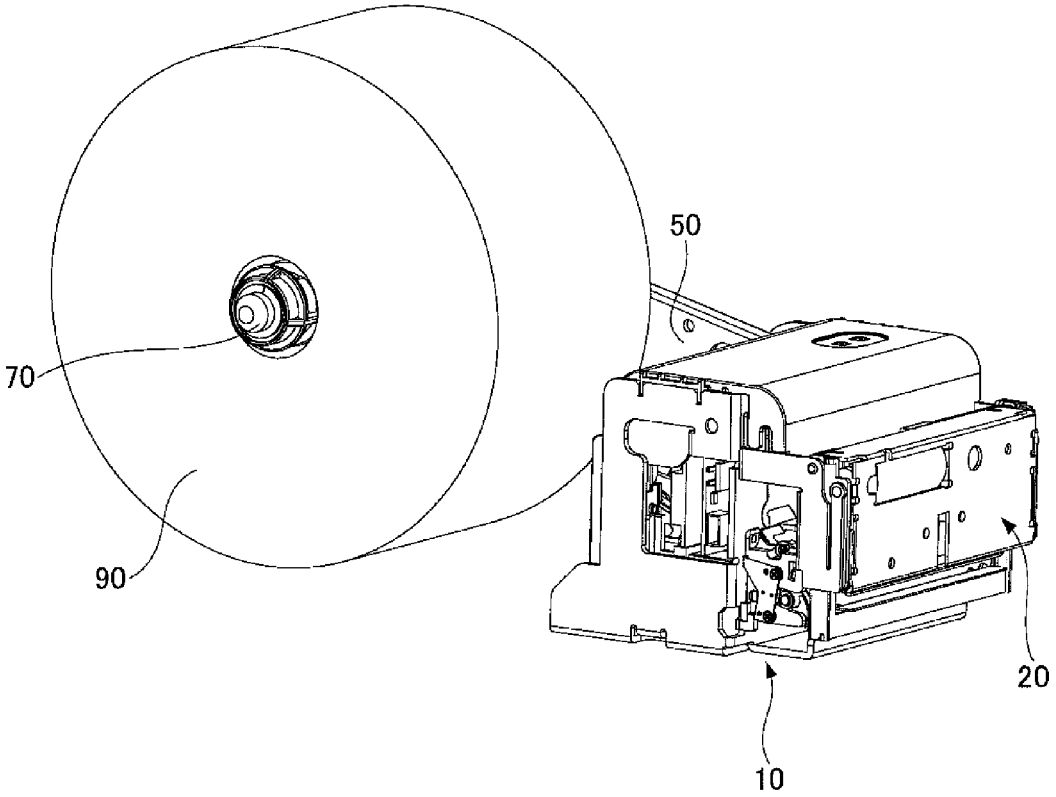
FIG. 36 is a perspective view of the printer loaded with a single roll of recording paper according to the sixth embodiment.
Figure 37:
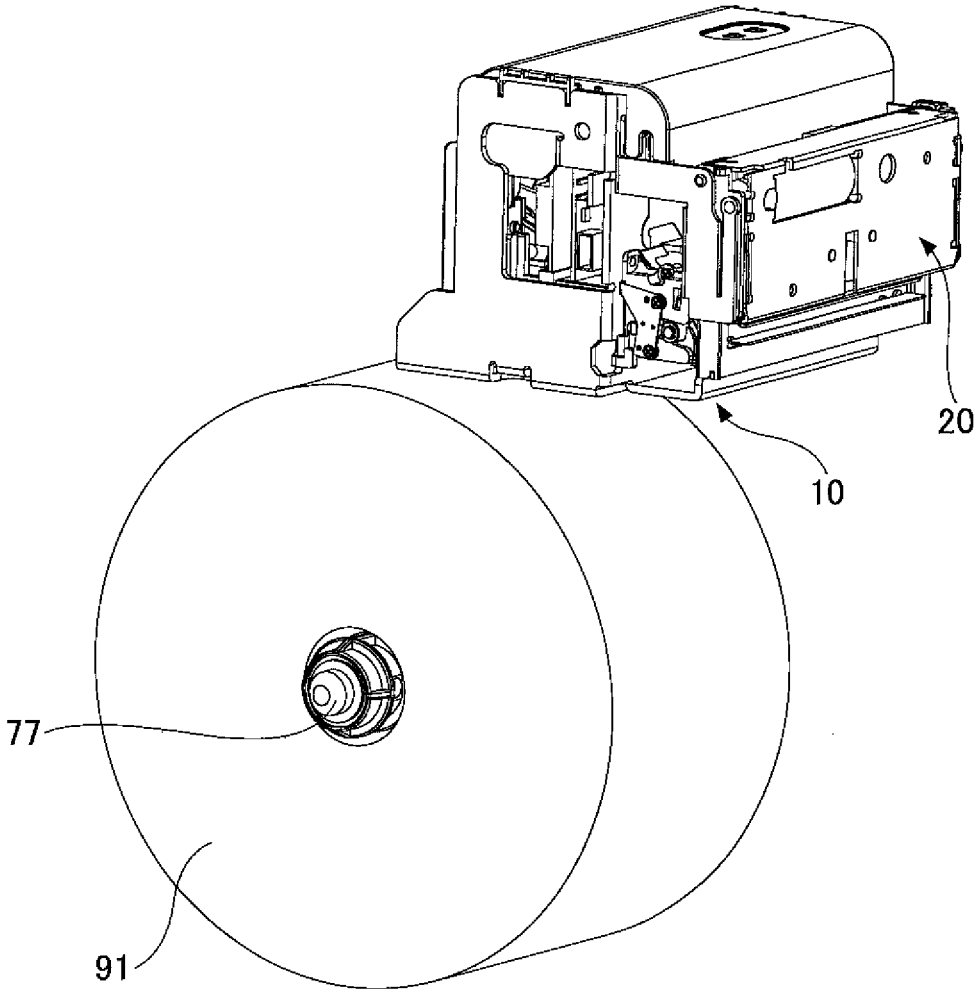
FIG. 37 is a perspective view of the printer loaded with another single roll of recording paper according to the sixth embodiment.
Figure 38:
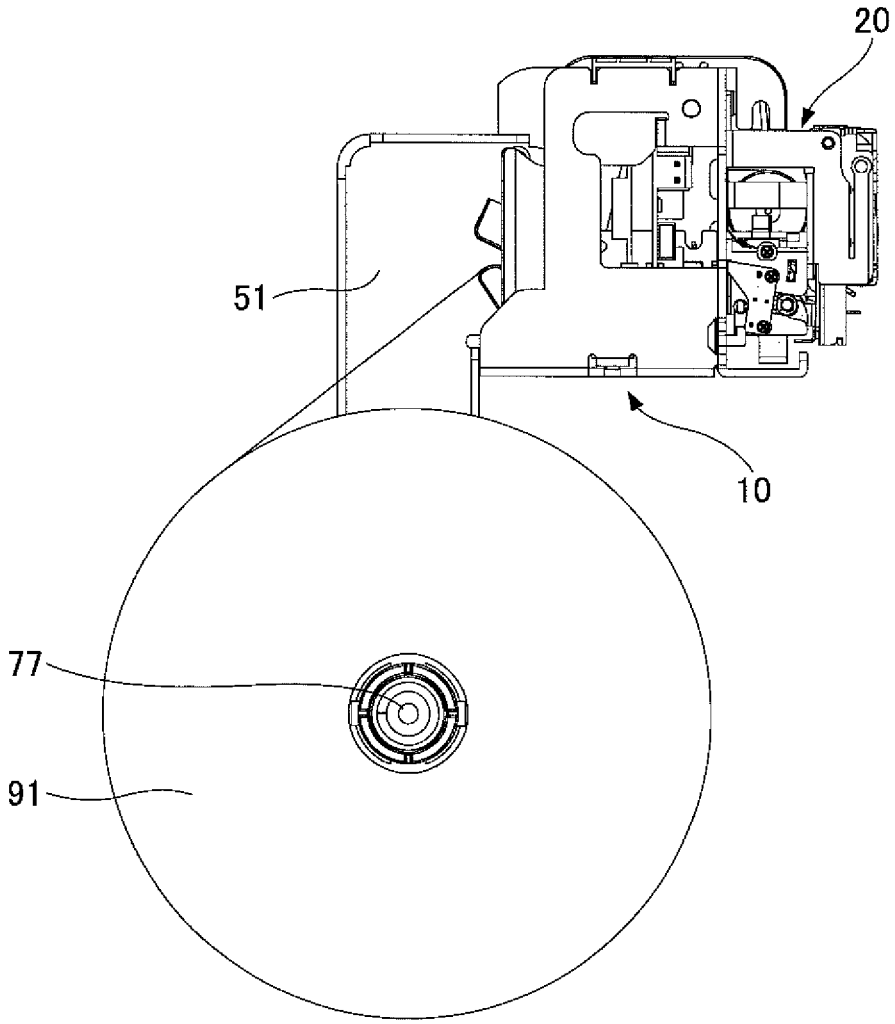
FIG. 38 is a diagram illustrating a configuration of the printer loaded with the single roll of recording paper illustrated in FIG. 37 according to the sixth embodiment.

Further, according to this embodiment, the state of the printer may be easily changed from the state illustrated in FIG. 36, where the recording paper 90 is attached, to the state illustrated in FIG. 37, where the recording paper 91 is attached, by attaching an arm unit different in shape to the mainframe 10. For example, as illustrated in FIG. 38, the arm unit 51 is attached to the mainframe 10 in place of the arm unit 50, and the paper feed shaft unit 77 is rotatably connected to the arm unit 51. Thus, the structure of the printer may be easily changed from the structure illustrated in FIG. 36, where the recording paper 90 is provided lateral to the printer, to the structure illustrated in FIG. 37, where the recording paper 90 is provided below the printer. Thus, it is possible to manufacture different types of printers in accordance with use.

Figure 39:
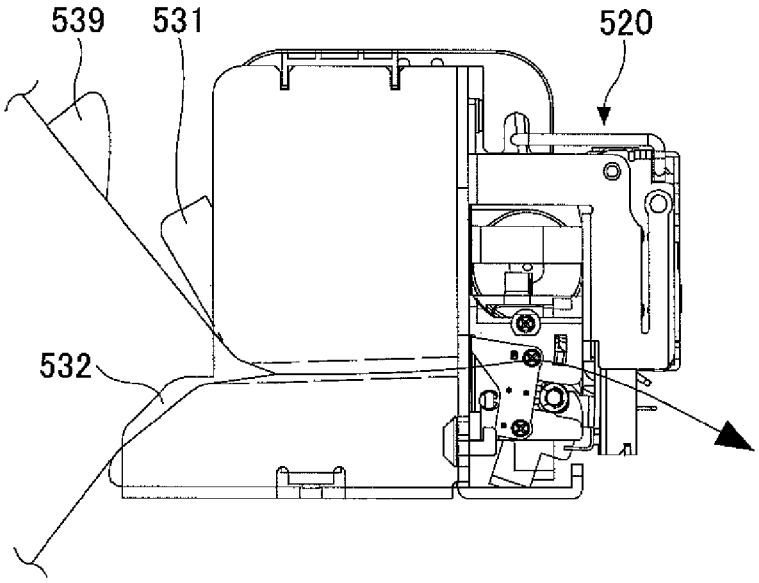
FIG.39 RELATED ART
FIG. 39 is a diagram illustrating a conventional recording paper guide unit.

Next, a description is given of the recording paper guide unit 30 according to this embodiment. Usually, printers using rolled recording paper include recording paper guides 531 and 532 for guiding the recording paper to a printer mechanism unit 520; and a damper 539 for preventing a slack in the recording paper as illustrated in FIG. 39. According to this embodiment, a printer is provided with two rolls of recording paper. However, if multiple dampers are also provided, this causes an increase in cost, and it takes more time to attach recording paper because of interference by the dampers. Further, in the case of manufacturing printers of different structures as illustrated in FIG. 36 and FIG. 37, a damper for unused recording paper may interfere to make it difficult to reduce the printers in size.

Figure 40:
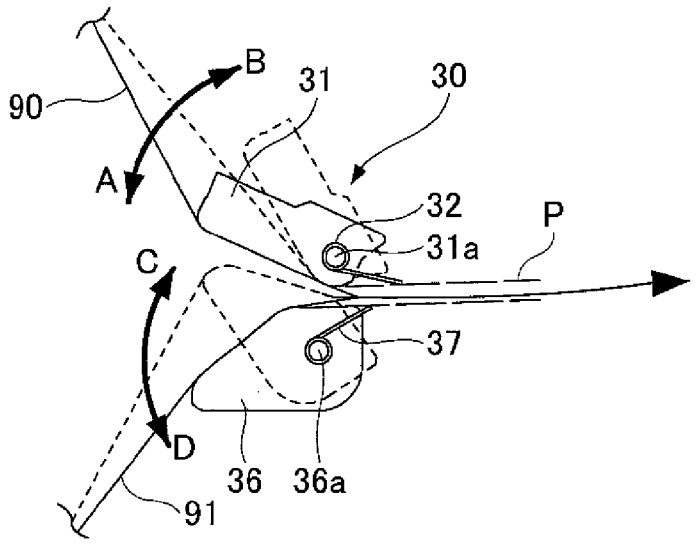
FIG. 40 is a diagram illustrating a structure of the recording paper guide unit according to the sixth embodiment.

According to the printer of this embodiment, the recording paper guide unit 30 operates both as a recording paper guide and as a damper, or supports both lateral loading and vertical loading (from the downside) of recording paper. For example, as illustrated in FIG. 40, the recording paper guide unit 30 includes the upper guide part 31 and the lower guide part 36.

The upper guide part 31 corresponds to the recording paper 90 illustrated in FIG. 34. The upper guide part 31 is so provided as to be movable (turnable) on a shaft 31*a*. The upper guide part 31 moves in a direction indicated by arrow A or a direction indicated by arrow B depending on the slack condition of the recording paper 90. A coil spring 32 is provided inside the upper guide part 31. The coil spring 32 is provided so that a force is applied to the end portion of the upper guide part 31, which end portion comes into contact with the recording paper 90, in the direction indicated by arrow A by the resilience of the coil spring 32. As a result, the upper guide part 31 operates as a recording paper guide and as a damper.

The lower guide part 36 corresponds to the recording paper 91 illustrated in FIG. 34. The lower guide part 36 is so provided as to be movable (turnable) on a shaft 36*a*. The lower guide part 36 moves in a direction indicated by arrow C or a direction indicated by arrow D depending on the slack condition of the recording paper 91. A coil spring 37 is provided inside the lower guide part 36. The coil spring 37 is provided so that a force is applied to the end portion of the lower guide part 36, which end portion comes into contact with the recording paper 91, in the direction indicated by arrow C by the resilience of the coil spring 37. As a result, the lower guide part 36 operates as a recording paper guide and as a damper.

Figure 41:
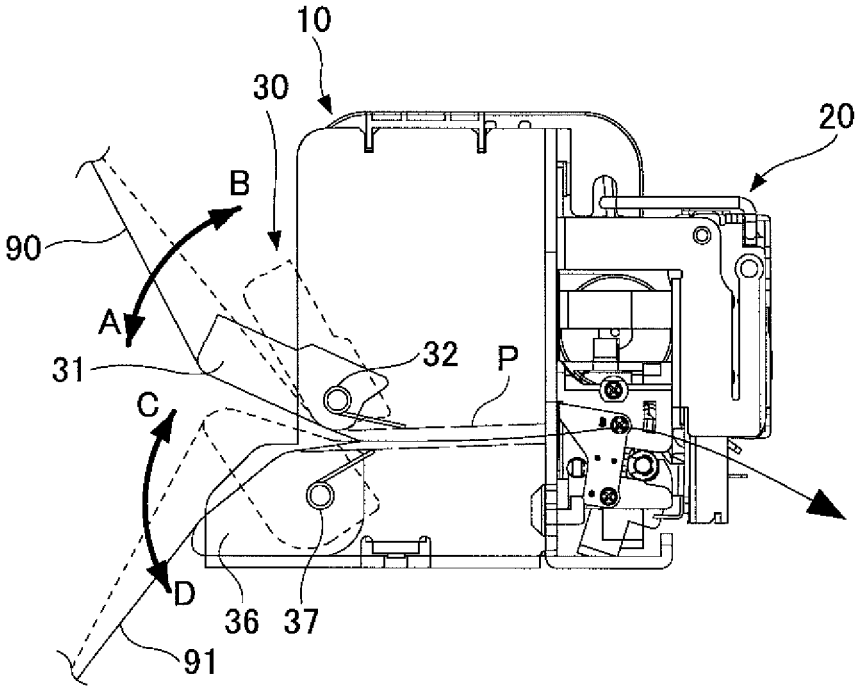
FIG. 41 is a diagram illustrating the recording paper guide unit according to the sixth embodiment.
Figure 42:
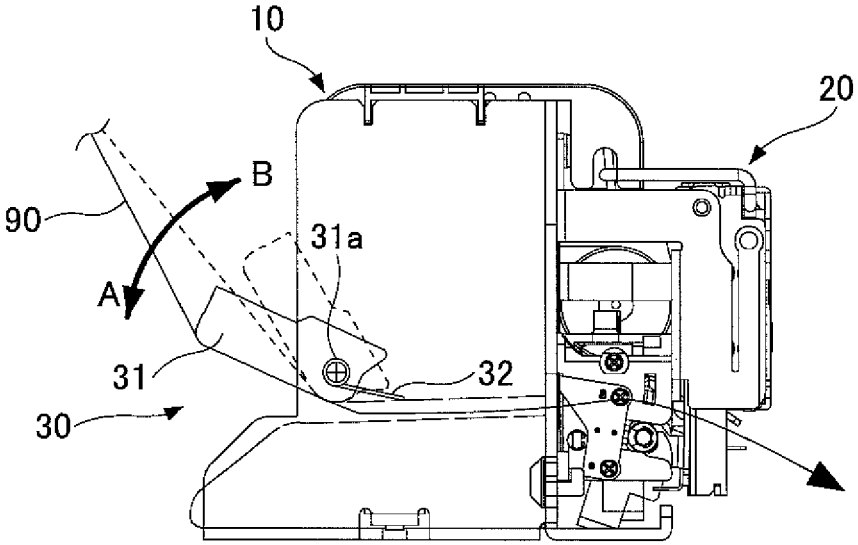
FIG. 42 is another diagram illustrating the recording paper guide unit according to the sixth embodiment.
Figure 43:
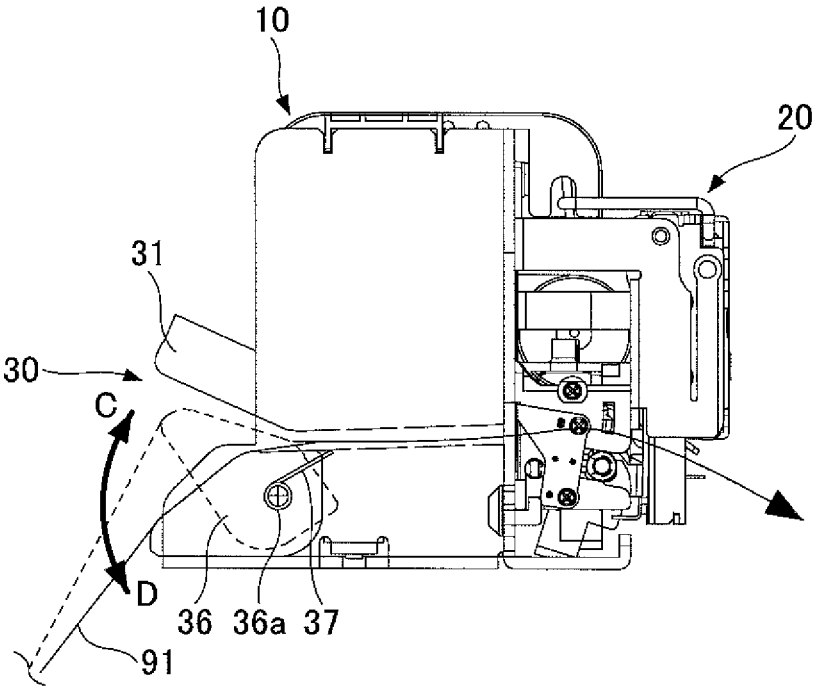
FIG. 43 is another diagram illustrating the recording paper guide unit according to the sixth embodiment.

FIG. 41 illustrates the printer unit where the recording paper guide unit 30 is connected to the mainframe 10 according to this embodiment. FIG. 42 illustrates the printer where the recording paper 90 is used and the upper guide part 31 is used in the recording paper guide unit 30. FIG. 43 illustrates the printer where the recording paper 91 is used and the lower guide part 36 is used in the recording paper guide unit 30. Thus, also in the case of loading the printer with two rolls of recording paper, the recording paper guide unit 30 operates both as a recording paper guide and as a damper for each roll of recording paper.

Figure 44:
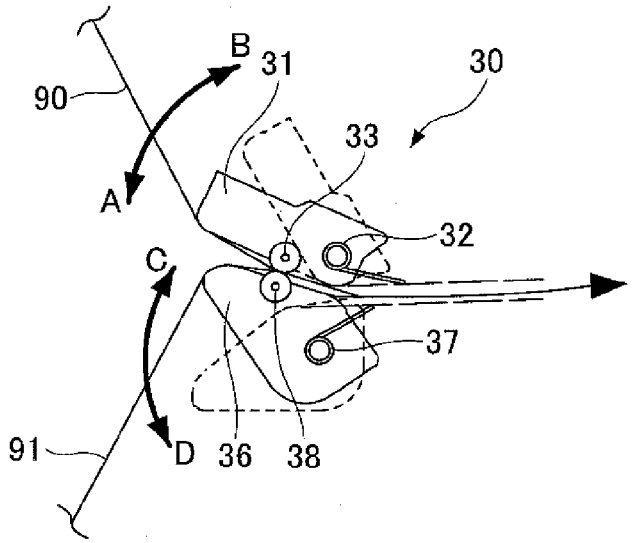
FIG. 44 is a diagram illustrating another structure of the recording paper guide unit according to the sixth embodiment.

Further, according to the recording paper guide unit 30 of this embodiment, the upper guide part 31 may include a pinch roller 33 that comes into contact with the recording paper 90, and the lower guide part 36 may include a pinch roller 38 that comes into contact with the recording paper 91 as illustrated in FIG. 44.

Figure 45:
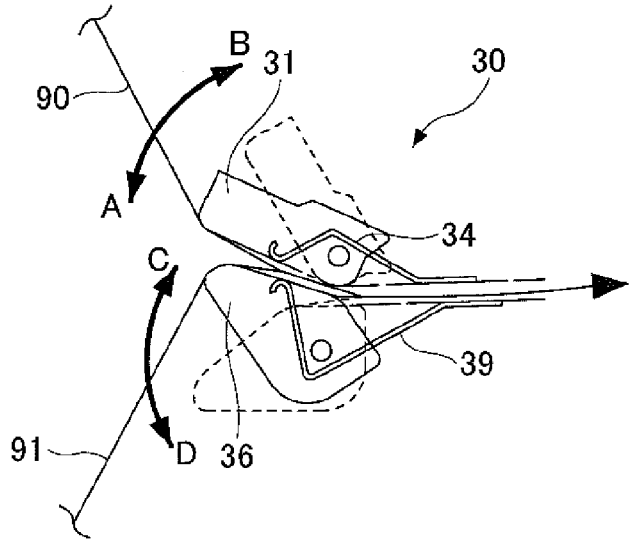
FIG. 45 is a diagram illustrating yet another structure of the recording paper guide unit according to the sixth embodiment.

Further, according to the recording paper guide unit 30 of this embodiment, the upper guide part 31 may replace the coil spring 32 with a leaf spring 34, and the lower guide part 36 may replace the coil spring 37 with a leaf spring 39 as illustrated in FIG. 45.

The recording paper guide unit 30 may also be applied to a printer configured to be loaded with a single roll of recording paper.

The sixth embodiment may be the same as the first embodiment except for the configuration described above.

[g] Seventh Embodiment

Next, a description is given of a seventh embodiment. A printer according to this embodiment includes a recording paper guide unit different from the recording paper guide unit 30 described in, for example, the sixth embodiment.

Figure 46:
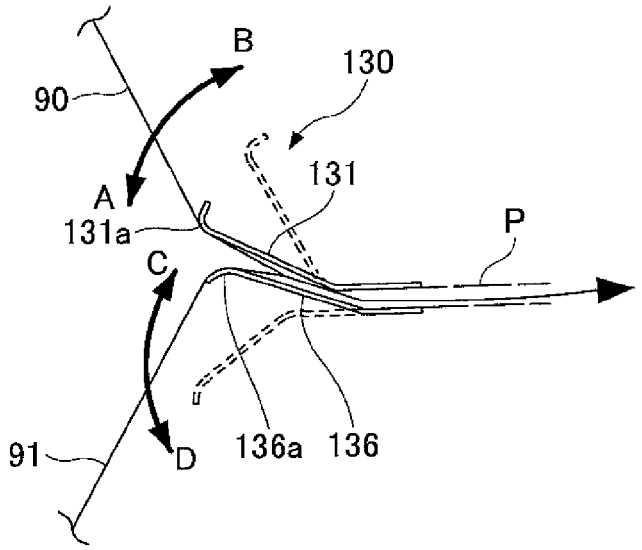
FIG. 46 is a diagram illustrating a structure of a recording paper guide unit according to a seventh embodiment.

A description is given, with reference to FIG. 46, of a recording paper guide unit 130 included in the printer of this embodiment. According to this embodiment, the recording paper guide unit 130 includes an upper leaf spring part 131 and a lower leaf spring part 136.

The upper leaf spring part 131 has an end portion smoothly bent to form a contact part 131*a*. The recording paper 90 comes into contact with the contact part 131*a*. The upper leaf spring part 131 has a spring characteristic, and deforms in accordance with the slack condition of the recording paper 90 so that the contact part 131*a* moves in a direction indicated by arrow A or a direction indicated by arrow B. The upper leaf spring part 131 is provided so that a force is applied to the contact part 131*a*, which comes into contact with the recording paper 90, in the direction indicated by arrow A by the spring characteristic of the upper leaf spring part 131. Thus, the upper leaf spring part 131 is a single member that operates both as a recording paper guide and as a damper.

The lower leaf spring part 136 has an end portion smoothly bent to form a contact part 136*a*. The recording paper 91 comes into contact with the contact part 136*a*. The lower leaf spring part 136 has a spring characteristic, and deforms in accordance with the slack condition of the recording paper 91 so that the contact part 136*a* moves in a direction indicated by arrow C or a direction indicated by arrow D. The lower leaf spring part 136 is provided so that a force is applied to the contact part 136*a*, which comes into contact with the recording paper 91, in the direction indicated by arrow C by the spring characteristic of the lower leaf spring part 136. Thus, the lower leaf spring part 136 is a single member that operates both as a recording paper guide and as a damper.

Figure 47:
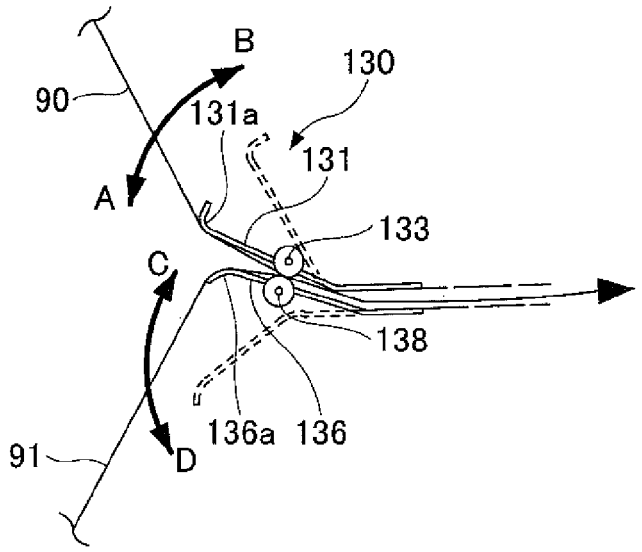
FIG. 47 is a diagram illustrating another structure of the recording paper guide unit according to the seventh embodiment.

Further, according to the recording paper guide unit 130 of this embodiment, the upper leaf spring part 131 may include a pinch roller 133 that comes into contact with the recording paper 90, and the lower leaf spring part 136 may include a pinch roller 138 that comes into contact with the recording paper 91 as illustrated in FIG. 47.

The seventh embodiment may be the same as the sixth embodiment except for the configuration described above.

[h] Eighth Embodiment

Next, a description is given of an eighth embodiment. A printer according to this embodiment includes a recording paper guide unit different from the recording paper guide unit 30 of the sixth embodiment and the recording paper guide unit 130 of the seventh embodiment.

Figure 48:
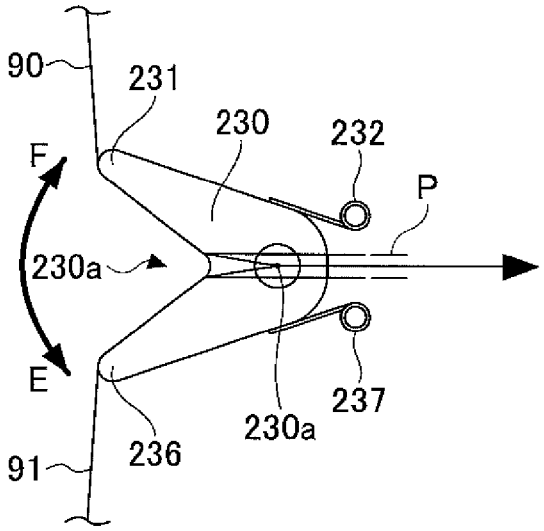
FIG. 48 is a diagram illustrating a structure of a recording paper guide unit according to an eighth embodiment.

A description is given, with reference to FIG. 48, of a recording paper guide unit 230 included in the printer according to this embodiment. According to this embodiment, the recording paper guide unit 230 is formed to have a V-shaped portion 230*a* where the recording paper 90 and the recording paper 91 enters the recording paper guide unit 230. The V-shaped portion 230*a* includes a guide upper part 231, which comes into contact with the recording paper 90, and a guide lower part 236, which comes into contact with the recording paper 91. That is, the V-shaped portion 230*a* is defined by the guide upper part 231 and the guide lower part 236.

According to the recording paper guide unit 230 of this embodiment, the guide upper part 231 and the guide lower part 236 may form a unitary (monolithic) structure. The recording paper guide unit 230 is movable (turnable) on a shaft 230*a*. A coil spring 232 and a coil spring 237 are provided one on each side of the recording paper guide unit 230, so that a force is applied to the end portion of the guide upper part 231 in a direction indicated by arrow E by the resilience of the coil spring 232 and a force is applied to the end portion of the guide lower part 236 in a direction indicated by arrow F by the resilience of the coil spring 237.

Figure 49:
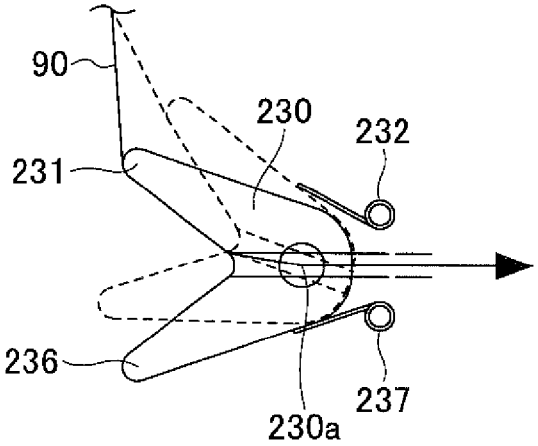
FIG. 49 is a diagram illustrating the recording paper guide unit according to the eighth embodiment.
Figure 50:
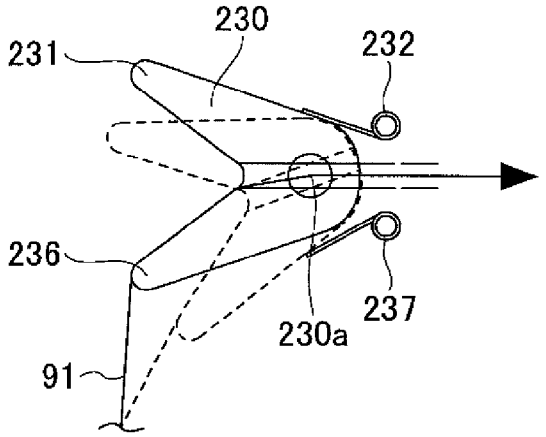
FIG. 50 is another diagram illustrating the recording paper guide unit according to the eighth embodiment.

Thus, the recording paper guide unit 230 operates both as a recording paper guide and as a damper. FIG. 49 illustrates the recording paper guide unit 230 where the guide upper part 231 is used in the case of using the recording paper 90. FIG. 50 illustrates the recording paper guide unit 230 where the guide lower part 236 is used in the case of using the recording paper 91.

Figure 51:
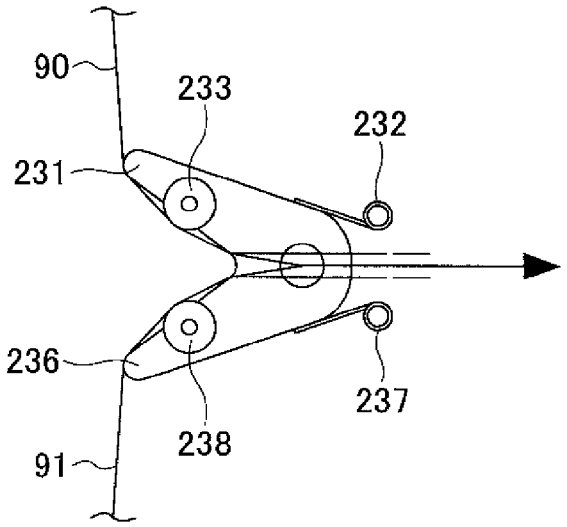
FIG. 51 is a diagram illustrating another structure of the recording paper guide unit according to the eighth embodiment.

Further, according to the recording paper guide unit 230, the guide upper part 231 may include a pinch roller 233 that comes into contact with the recording paper 90, and the guide lower part 236 may include a pinch roller 238 that comes into contact with the recording paper 91 as illustrated in FIG. 51.

Figure 52:
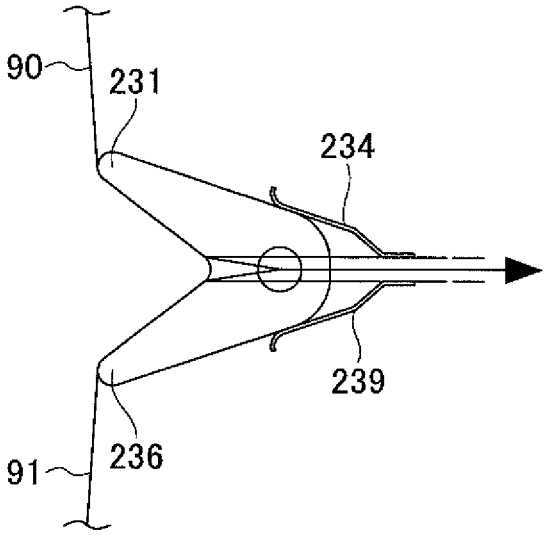
FIG. 52 is a diagram illustrating another structure of the recording paper guide unit according to the eighth embodiment.

Further, according to the recording paper guide unit 230, the guide upper part 231 may replace the coil spring 232 with a leaf spring 234, and the guide lower part 236 may replace the coil spring 237 with a leaf spring 239 as illustrated in FIG. 52.

The eighth embodiment may be the same as the sixth embodiment except for the configuration described above.

[i] Ninth Embodiment

Next, a description is given of a ninth embodiment. A printer according to this embodiment allows recording paper to be easily inserted into a recording paper guide unit.

A description is given, with reference to FIGS. 53A, 53B, 53C, and 53D, of a recording paper guide unit 300 included in the printer of this embodiment. According to the printer of this embodiment, the recording paper guide unit 300 includes an upper guide part 310 and the lower guide part 36. An opening part 311 is formed in the upper guide part 310. The recording paper guide unit 300 further includes a shaft 312 configured to enter the opening part 311 and a spring 313 connected to the shaft 312.

According to this embodiment, the shaft 312 connected to the spring 313 enters the opening 311 of the upper guide part 310, so that the upper guide part 310 is fixed. As a result, the entire recording paper guide unit 300 is fixed so as to allow recording paper to be easily inserted between the upper guide part 310 and the lower guide part 36.

Figure 53A:
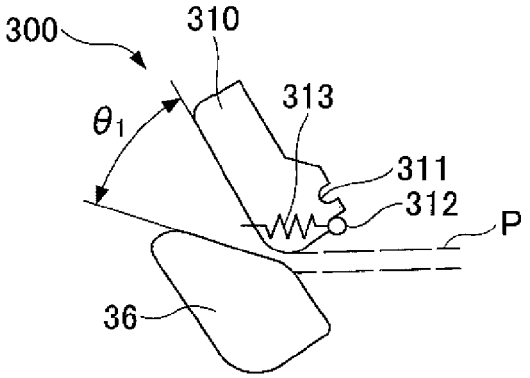
FIGS. 53A through 53D are diagrams illustrating a recording paper guide unit according to a ninth embodiment.
Figure 53B:
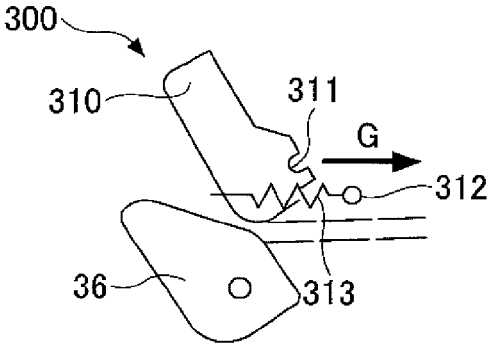

First, the shaft 312 in the state illustrated in FIG. 53A is pulled in a direction indicated by arrow G as illustrated in FIG. 532. At this point, the spring 313 is stretched to generate resilience in a returning direction.

Figure 53C:
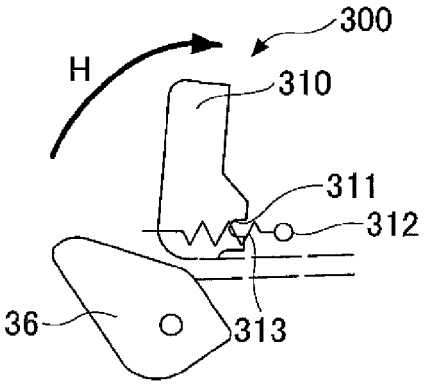

Thereafter, as illustrated in FIG. 53C, the end portion of the upper guide part 310 is lifted in a direction indicated by arrow H, that is, upward.

Figure 53D:
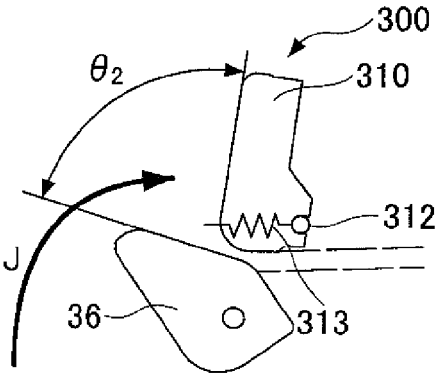

Thereafter, as illustrated in FIG. 53D, the shaft 312 is caused to enter the opening part 311 of the upper guide part 310 and fixed by the resilience of the spring 313. As a result, the positions of the upper guide part 310 and the lower guide part 36 are fixed so as to allow recording paper to easily pass between the upper guide part 310 and the lower guide part 36. For example, an angle θ2 of the recording paper entrance formed by the upper guide part 310 and the lower guide part 36 illustrated in FIG. 53D is greater than an angle θ1 of the recording paper entrance formed by the upper guide part 310 and the lower guide part 36 illustrated in FIG. 53A. This makes it easier to cause recording paper to enter the space (gap) between the upper guide part 310 and the lower guide part 36. In FIG. 53D, the direction indicated by arrow J indicates the case of causing recording paper to be inserted between the upper guide part 310 and the lower guide part 36 from the downside. Alternatively, the recording paper may also be caused to be laterally inserted between the upper guide part 310 and the lower guide part 36. After the entry of the recording paper into the space between the upper guide part 310 and the lower guide part 36, the upper guide part 310 may be unfixed by removing (disengaging) the shaft 312 from the opening part 311.

Figure 54A:
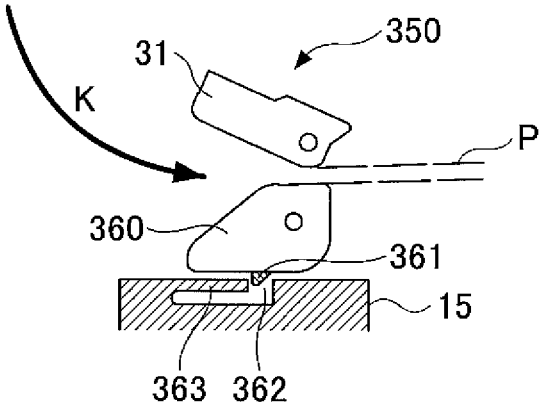
FIGS. 54A and 54B are diagrams illustrating another recording paper guide unit according to the ninth embodiment.
Figure 54B:
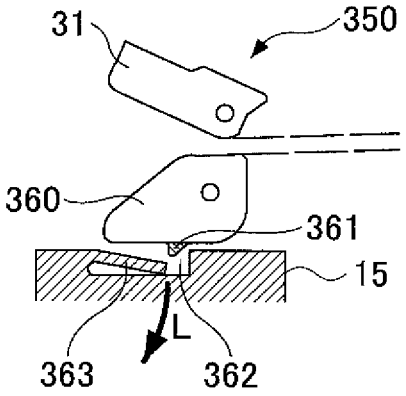

FIGS. 54A and 54B are diagrams illustrating another recording paper guide unit 350 according to this embodiment. The recording paper guide unit 350 includes the upper guide part 31 and a lower guide part 360. In the case of causing recording paper to enter the recording paper guide unit 350, the lower guide part 360 may be fixed. The lower guide part 360 includes a projecting part 361. An opening part 362 corresponding to the projecting part 361 and a lock part 363 configured to let the projecting part 361 out of the opening part 362 are provided in the bottom face part 15 of the mainframe 10 or the bottom face of the recording paper guide unit 350. According to this embodiment, an end portion of the lock part 363 defines part of the edge of the opening part 362.

For example, as illustrated in FIG. 54A, the lower guide part 360 is fixed by fitting the projecting part 361 into the opening part 362. As a result, the positions of the upper guide part 31 and the lower guide part 360 are fixed so as to facilitate the entry of recording paper into the space between the upper guide part 31 and the lower guide part 360. In FIG. 54A, a direction indicated by arrow K indicates the case of a lateral entry of recording paper by way of example. Alternatively, the recording paper may also be caused to enter from the downside.

As illustrated in FIG. 54B, in the case of letting the projecting part 361 out of the opening part 362, the lock part 363 is pressed in a direction indicated by arrow L to deform the lock part 363, thereby deforming the opening part 362. As a result, the projecting part 361 is allowed to come out of (disengage from) the opening part 362, so that it is possible to unfix the lower guide part 360.

The recording paper guide unit 30 of the sixth embodiment may be modified in structure into the recording paper guide unit 300 or the recording paper guide unit 350 according to this embodiment. The structures according to this embodiment may also be applied to the recording paper guide units 130 and 230 of the seventh embodiment and the eighth embodiment.

According to an aspect of the present invention, a printer includes a printer mechanism unit configured to perform printing on recording paper loaded in a rolled state; a recording paper guide unit configured to guide the recording paper to the printer mechanism unit; and a plurality of paper feed shaft units configured to hold respective rolls of the recording paper attached thereto.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A printer, comprising:

a mainframe, the mainframe including a front face part that has an opening through which a recording medium is discharged from the mainframe to be subjected to printing;

a guide unit connected to the mainframe on an upstream side of the front face part relative to a conveyance direction in which the recording medium is conveyed through the opening, wherein the guide unit includes a concave fixing part provided on a surface of the guide unit;

a printer mechanism unit configured to perform the printing on the recording medium discharged from the mainframe, and connected to the mainframe on a downstream side of the front face part relative to the conveyance direction;

a rectangular plate-shaped printed board connected perpendicularly to the surface of the guide unit by being fit into the concave fixing part of the guide unit, wherein the rectangular plate-shaped printed board includes a mounting surface having an electronic component mounted thereon, the mounting surface being one of first and second surfaces of the rectangular plate-shaped printed board that are opposite in a thickness direction of the rectangular plate-shaped printed board, wherein the mounting surface faces a direction in which the recording medium is discharged from the mainframe, and faces a surface of the front face part at which the opening is formed;

an arm unit having a first end connected to the mainframe; and a shaft unit configured to hold a roll of the recording medium, and connected to a second end of the arm unit, wherein the guide unit is configured to guide the recording medium so as to feed the recording medium to the printer mechanism unit through the opening of the front face part of the mainframe.

2. The printer as claimed in claim 1, wherein:

the mainframe further includes a first sidewall extending from a first side end of the front face part, and a second sidewall extending from a second side end of the front face part, the first and second sidewalls being substantially perpendicular to the front face part, the first and second sidewalls face each other across the guide unit, the first and second sidewalls are on the upstream side of the front face part, and the first end of the arm unit is connected to the first sidewall of the mainframe.

3. The printer as claimed in claim 2, wherein:

the mainframe further includes a bottom face part connected to the front face part and the first and second sidewalls on the upstream side of the front face part, and the guide unit is connected to the bottom face part of the mainframe.

4. The printer as claimed in claim 2, further comprising:

an additional arm unit connected to the second sidewall of the mainframe.

5. The printer as claimed in claim 1, wherein the arm unit includes a near-end detecting unit configured to detect a remaining amount of the recording medium.

6. The printer as claimed in claim 1, wherein:

the printer mechanism unit includes a printer unit configured to perform the printing on the recording medium, and a cutter unit configured to cut the recording medium, and the printer unit and the cutter unit are separably connected.

7. The printer as claimed in claim 1, wherein:

the concave fixing part includes a plurality of concave portions each including a plurality of projections projecting vertically from the surface of the guide unit, and an edge of the rectangular plate-shaped printed board is fit into a space between the plurality of projections of each of the plurality of concave portions.

8. A printer, comprising:

a mainframe formed of a single metal plate that is bent, the mainframe including a front face part that has an opening through which a recording medium is discharged from the mainframe to be subjected to printing;

a first sidewall and a second sidewall extending from a first side end and a second side end, respectively, of the front face part in a direction perpendicular to a surface of the front face part at which the opening is formed; and a bottom face part that extends substantially perpendicularly from the first sidewall and the second sidewall and is substantially perpendicular to the front face part;

a guide unit connected to the bottom face part on an upstream side of the front face part relative to a conveyance direction in which the recording medium is conveyed through the opening;

a printed board connected perpendicularly to a surface of the guide unit; and a printer mechanism unit configured to perform the printing on the recording medium discharged from the mainframe, and connected to the front face part on a downstream side of the front face part relative to the conveyance direction, wherein the guide unit is configured to guide the recording medium so as to feed the recording medium to the printer mechanism unit through the opening of the front face part of the mainframe, wherein the printed board and the bottom face part are on opposite sides of the guide unit in a direction perpendicular to the surface of the guide unit to which the printed board is connected, and wherein the first and second sidewalls face each other across the guide unit.

9. The printer as claimed in claim 8, further comprising:

an arm unit having a first end connected to the first sidewall of the mainframe; and a shaft unit configured to hold a roll of the recording medium, and connected to a second end of the arm unit, wherein the arm unit extends from the first sidewall of the mainframe to have the shaft unit positioned outside the mainframe.

10. The printer as claimed in claim 8, wherein the printed board is screwed to a part of the mainframe extending perpendicularly from the first sidewall, and the printed board includes a mounting surface having an electronic component mounted thereon, the mounting surface being perpendicular to a direction in which the printed board is screwed to the part of the mainframe, and facing the surface of the front face part at which the opening is formed.

11. The printer as claimed in claim 8, wherein the guide unit is screwed to the bottom face part.

12. The printer as claimed in claim 8, wherein the printer mechanism unit is screwed to the front face part.

13. A printer, comprising:

a mainframe, the mainframe including a front face part that has an opening through which a recording medium is discharged from the mainframe to be subjected to printing;

a guide unit connected to the mainframe on an upstream side of the front face part relative to a conveyance direction in which the recording medium is conveyed through the opening, wherein the guide unit includes a concave fixing part provided on a surface of the guide unit;

a printer mechanism unit configured to perform the printing on the recording medium discharged from the mainframe, and connected to the mainframe on a downstream side of the front face part relative to the conveyance direction;

a rectangular plate-shaped printed board having a first side and a second side longer than the first side, and connected perpendicularly to the surface of the guide unit with the longer second side being fit into the concave fixing part of the guide unit, wherein the rectangular plate-shaped printed board includes a mounting surface having an electronic component mounted thereon, the mounting surface being one of first and second surfaces of the rectangular plate-shaped printed board that are opposite in a thickness direction of the rectangular plate-shaped printed board, wherein the mounting surface faces a direction in which the recording medium is discharged from the mainframe, and faces a surface of the front face part at which the opening is formed;

an arm unit having a first end connected to the mainframe; and a shaft unit configured to hold a roll of the recording medium, and connected to a second end of the arm unit, wherein the guide unit is configured to guide the recording medium so as to feed the recording medium to the printer mechanism unit through the opening of the front face part of the mainframe.

* * * * *